United States Patent [19]

Fisher et al.

[11] Patent Number: 4,779,812

[45] Date of Patent: Oct. 25, 1988

[54] TOROIDAL ELECTRICAL TRANSFORMER AND METHOD OF PRODUCING SAME

[75] Inventors: John L. Fisher, Lexington; Herbert J. Macemon; James D. Richerson, both of Versailles; Richard W. Wiedo, Frankfort; Joe E. Curtis, Jr., Lexington, all of Ky.; James F. Rafferty, Fairview Park; Thomas H. Aishton, Whitehall, both of Ohio

[73] Assignee: Kuhlman Corporation, Troy, Mich.

[21] Appl. No.: 5,326

[22] Filed: Jan. 15, 1987

Related U.S. Application Data

[63] Continuation of Ser. No. 750,045, Jun. 27, 1985, abandoned, which is a continuation of Ser. No. 337,356, Jan. 6, 1982, abandoned.

[51] Int. Cl.[4] ..... H01F 3/04

[52] U.S. Cl. ..... 242/7.07

[58] Field of Search ..... 242/4 R, 4 A, 1.1 E, 242/7.01, 7.07; 29/605

[56] References Cited

U.S. PATENT DOCUMENTS

| | | | |
|---|---|---|---|
| 1,940,175 | 12/1933 | Loubet | 242/4 R |
| 2,191,393 | 2/1940 | Humphreys | 29/605 |
| 2,245,180 | 6/1941 | Boyajian | 242/4 R |
| 2,758,796 | 8/1956 | Zwelling | 242/4 A |
| 2,811,699 | 10/1957 | Whittier | 336/69 |
| 3,049,793 | 8/1962 | Cooper | 29/605 |
| 3,060,353 | 10/1962 | Shansky et al. | 317/158 |
| 3,340,489 | 9/1967 | Bastis et al. . | |
| 3,786,353 | 1/1974 | Pun . | |
| 4,524,342 | 6/1985 | Mas | 336/182 |

FOREIGN PATENT DOCUMENTS

| | | |
|---|---|---|
| 0082954 | 11/1982 | European Pat. Off. . |
| 221001 | 4/1910 | Fed. Rep. of Germany . |
| 479292 | 7/1929 | Fed. Rep. of Germany . |
| 488284 | 1/1930 | Fed. Rep. of Germany . |
| 2309109 | 11/1976 | France . |
| 13569 | 4/1980 | Japan . |
| 19116 | 4/1912 | United Kingdom . |
| 989544 | 4/1965 | United Kingdom . |
| 1079815 | 8/1967 | United Kingdom . |

OTHER PUBLICATIONS

Patent Abstracts of Japan, vol. 1, No. 19, 3/24/77, p. 548 E 76; Kokai No. 51-116929; Appln. No. 50-41460.

European Search Report, EP 87-20,039, 4-1987.

"Transformers Principles and Applications", American Technical Society, 12/1947, by Dunlap et al, pp. 1-37.

Trends in High Efficiency Distribution Transformers for the 1980's by Donald J. Bailey, Oct. 8, 1986.

"Type Testing of Amorphous Metal Distribution Transformers", by Dorman W. Whitley, Westinghouse Electric Corporation.

"Losses and Sound Level of Amorphous Metal Cores", by K. C. Lin, Westinghouse Electric Corporation, date unknown.

*Primary Examiner*—Stuart S. Levy

*Assistant Examiner*—Joseph J. Hail, III

*Attorney, Agent, or Firm*—Townsend and Townsend

[57] ABSTRACT

A toroidal electrical transformer having a low voltage coil, a high voltage coil and an annular magnetic core is disclosed. The preferred low voltage and high voltage coils are each continuous in substantial part over their length and form an arcuate elongated passage therethrough. The preferred annular magnetic core is wound in place in said arcuate elongated passage substantially from a continuous strip of magnetic material. Various components and sub-assemblies are also disclosed along with various apparatus and methods for producing such toroidal electrical transformer, its components and its sub-assemblies.

2 Claims, 17 Drawing Sheets

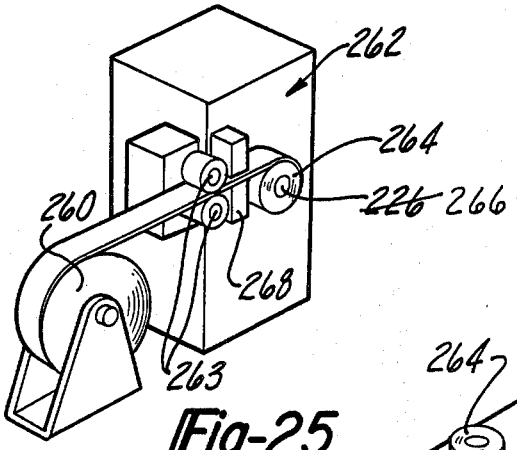
Fig-25
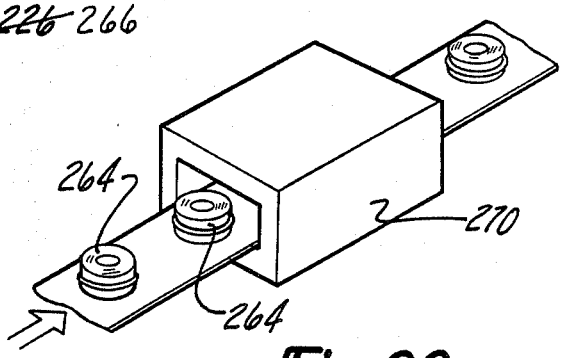
Fig-26
Fig-27
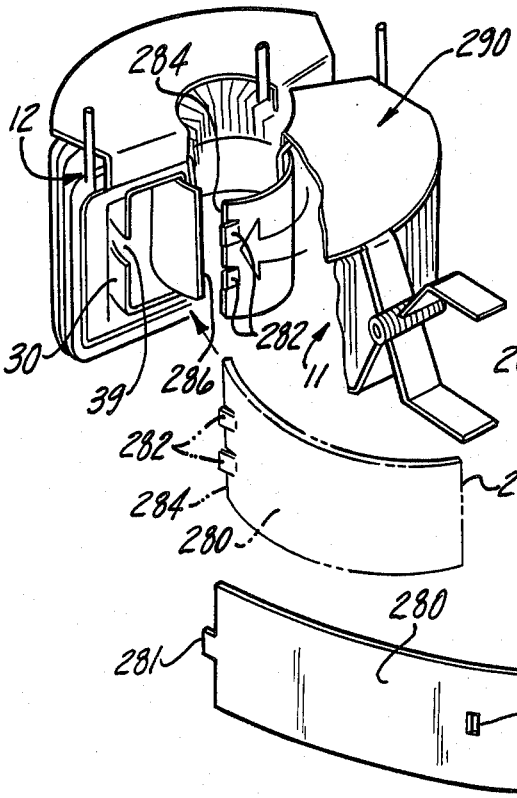
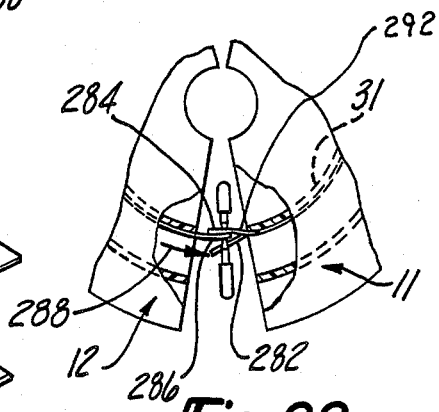
Fig-28
Fig-28A

TOROIDAL ELECTRICAL TRANSFORMER AND METHOD OF PRODUCING SAME

This is a continuation of application Ser. No. 750,045 filed June 27, 1985 which is a continuation of application Ser. No. 337,356 filed Jan. 6, 1982 both of which are now abandoned.

BACKGROUND AND SUMMARY OF THE INVENTION

The invention relates to an alternating current electrical transformer and more particularly to a toroidal electrical transformer having a core wound from one or more continuous strips of core material and high and low voltage windings, each wound in substantial part from a continuous conductor.

Ideally, an electrical toroidal transformer having a continuously-wound, annular or toroidal core and continuous toroidal low voltage and high voltage windings, with each winding or segment thereof being wedge-shaped, would provide a transformer of nearly optimum operating efficiency. The continuously wound annular or toroidal transformer core of such a transformer would minimize the effective magnetic path length and the parasitic core losses. Furthermore, the continuous toroidal electrical windings of such a transformer with each winding being wedge-shaped, would optimize the use of an annular or toroidal transformer core by providing the smallest effective electrical coil path length. Previously known transformer designs have not, however, accomplished all of these objectives.

Various proposals have been made to provide a transformer having a wound, annular core and toroidal windings surrounding the core. For example, the patent to Bastis, et al, U.S. Pat. No. 3,430,489, issued Sept. 5, 1967, discloses an air-cooled toroidal transformer in which the core is severed into two segments so that the windings can be positioned onto the core segments before they are joined. A similar technique is shown in the patent to Conner, et al, U.S. Pat. No. 3,996,543, issued Dec. 7, 1976. A segmented core is used in Conner, et al, because of the problems associated with winding the primary and secondary windings on a continuous toroidal core using conventional winding machines.

Efforts have been made to wind a more-or-less continuous annular or toroidal core into preformed, generally-rectangular primary and secondary windings. Examples of such efforts are shown in the patents to Humphreys, U.S. Pat. No. 2,191,393, issued Feb. 2, 1940; Vance, U.S. Pat. No. 2,249,506, issued July 25, 1941; Granfield, U.S. Pat. No. 2,160,588, issued May 30, 1939; Boyajian, U.S. Pat. No. 2,245,180, issued June 10, 1941; Brand, U.S. Pat. No. 2,246,239, issued June 17, 1941; Brand, U.S. Pat. No. 2,246,240, issued June 17, 1941; Camilli, U.S. Pat. No. 2,248,606, issued July 8, 1947; Driftmeyer, U.S. Pat. No. 2,282,854, issued May 12, 1942; Steinmayer, U.S. Pat. No. 2,344,006, issued Mar. 14, 1944; and Steinmayer, U.S. Pat. No. 2,401,984, issued June 11, 1946. The aforementioned patents, however, illustrate that it was not deemed feasible to wind such a continuous core into continuous, preformed toroidal windings.

Finally, a process for heat treating a toroid wound from an amorphous metal material is disclosed in a patent issued to Becker et al, U.S. Pat. No. 4,116,728, issued Sept. 26, 1978; and a process for dipping a preformed electrical coil in a liquid insulation bath and curing the insulative coating in an oven is disclosed in a patent issued to Schou, U.S. Pat. No. 2,061,388, issued Nov. 17, 1936. According to the present invention, a toroidal electrical transformer of near optimum efficiency includes a wound magnetic core that is continuous at least in substantial part and generally toroidal or annular in configuration. The magnetic core is surrounded by high and low voltage coils or windings that are also continuous in substantial part and generally toroidal in configuration. Such high and low voltage coils or windings form an arcuate elongated passage extending therethrough in which the magnetic core is disposed. Although the arcuate elongated passage encompasses at least one-half of the circumferential length of the magnetic core, the advantages of the present invention are best obtained if such arcuate elongated passage encompasses 75 to 95 percent of said circumferential length of the magnetic core.

The above structure and configuration is preferably accomplished by preforming the high and low voltage windings into two coreless and semi-toroidal or arcuate transformer portions or sections, each constituting substantially one-half of the transformer. The magnetic core material is then fed through a small circumferentially-extending gap between adjacent ends of such semi-toroidal portions or sections and continuously wound in place into the generally toroidal or arcuate elongated passage formed in said portions or sections. Such circumferentially-extending gap is preferably sufficient in circumferential length, but not longer than necessary, to allow the magnetic core material to be fed therethrough and wound in place within the arcuate elongated passage to form the annular magnetic core.

In the preferred embodiment of the toroidal transformer, the high voltage coil or winding is wound into a number of wedge-shaped bundles or segments with connecting loops of wire or conductor. Preferably in order to achieve the advantages of the invention, such wedge-shaped segments and connecting loops are wound and formed from a pre-insulated wire or conductor that is continuous over 30 to 50 percent of the total length of the high voltage coil. At a minimum, according to the invention, each wedge-shaped segment is wound and formed from a continuous wire or conductor.

The low voltage coil or winding in the preferred embodiment is wound and formed from conductor stock in a singular or a multifilar arrangement wherein each turn is wedge-shaped and may also be composed of two parallel coils interleaved in a spiral or double helix configuration as is explained in detail below. Preferably in order to achieve the advantages of the invention, such conductor is continuous over 30 to 50 percent of the total length of the low voltage coil for at least each voltage winding thereof in a multi-voltage arrangement. At a minimum, according to the invention, such low voltage conductor is continuous over three or more turns of the coil in each of the above-mentioned transformer portions or sections for each voltage winding thereof.

The preferred magnetic core is fed through a gap between the ends of the high voltage and low voltage windings and is wound in place into a generally toroidal or annular opening which extends through the high and low voltage coils to form an arcuate elongated passage therethrough. The core is preferably formed and wound from a single continuous ribbon-like strip of core material. Alternatively, however, the magnetic core may be wound from a number of continuous strips of core material in a parallel bifilar or parallel multifilar arrangement. Also, in the construction of very large toroidal transformers, a separate single strip or a multifilar group of strips may be used to wind an inner portion of the core diameter, with one or more subsequent single strips or multifilar group of strips serially connected thereto for forming increasing diametric regions or portions of the wound core. In this configuration, the subsequent, or serially-connected, single strips or groups of strips may include different types of core material, having different loss characteristics, at different diametric regions of the wound core as is described in U.S. Pat. No. 4,025,288, issued to Lin et al, on May 27, 1980. In such serially wound configurations, the magnetic core is considered to be substantially continuous or continuous in substantial part.

The toroidal or arcuate configuration of the high and low voltage coils in the preferred embodiment is that of a torus generated by the revolution of a generally trapezoidal shape about an external axis, while the toroidal or annular configuration of the preferred magnetic core is that generated by the revolution of a generally rectangular shape about an external axis with such core configuration being substantially defined by the abovementioned arcuate elongated passage through the high and low voltage coils. As is explained below, however, such toroidal configurations may alternatively be those generated by the toroidal revolution of any of a number of geometric shapes, including, for example, circles, ovals, squares, or even irregular shapes.

Since the core structure in the present invention is continuous, as described above, magnetic flux losses due to gaps or breaks in the core material are minimized. Since the structure of the primary and secondary windings is continuous in substantial part, as described above, electrical losses due to connections in those windings are likewise minimized. Because the high voltage and low voltage windings are toroidal in configuration, with each winding segment being wedge-shaped, optimum use is made of the wound-in toroidal or annular transformer core. The minimizing of such magnetic flux losses and electrical losses is especially timely since energy conservation is presently a national goal.

A toroidal electrical transformer according to the invention is preferably constructed by preforming the high voltage and low voltage coils or windings, which are then assembled onto toroidal or annular insulation structures to form a coreless toroidal winding and insulation structure having a generally annular or toroidal-shaped central void or core-forming tunnel which forms an arcuate elongated passage therethrough. Thereafter, the core material is fed into the preformed toroidal winding and insulation structure through a relatively small, circumferentially-extending gap between adjacent ends of the portions or sections of such structure and wound in place to form the finished transformer. Various novel techniques are disclosed herein to accomplish these steps.

Of particular importance is the fact that the core material of a toroidal transformer according to the invention may be extremely thin. Recent advances in core material technology have provided amorphous metals, an example of which is known by the tradename METGLAS. Because such amorphous metals are fabricated by solidifying the molten metal in a very short period of time, such amorphous metals must be of an extremely thin gauge as compared with core materials composed of conventional grain-oriented metals. Such thin-gauge core materials are difficult, if not impractical, to use with conventional core manufacturing techniques. The transformer manufacturing method of the present invention, however, can efficiently accommodate such thin-gauge amorphous metal core materials, thereby further improving the efficiency and reducing the parasitic losses of the transformer.

Other features and advantages of the invention will become apparent in the description of the preferred embodiments set forth below.

BRIEF DESCRIPTION OF THE DRAWINGS

Exemplary embodiments of the present invention are illustrated in the accompanying drawings, wherein:

FIGS. 11 and 12 are detail views of the low voltage coil forming roller assembly of the apparatus of FIG. 9, wherein:

FIG. 11 illustrates the roller position for forming the inner leg of the low voltage coil; and FIG. 12 illustrates the roller position for forming the outer leg of the low voltage coil;

FIGS. 15 and 16 are two variations of the method for applying insulation to the low voltage coil assemblies, wherein:

FIG. 15 illustrates an apparatus for dipping the low voltage coil into a liquid insulation material; and FIG. 16 illustrates an apparatus for electrostatically applying a powdered insulation material to the low voltage coil;

FIGS. 21 through 23 are top views of the winding and forming portion of the apparatus of FIG. 17, illustrating the coil segment pressing operation, wherein:

FIG. 21 shows one of such segments after winding and during pressing;

FIG. 22 is similar to FIG. 21, but is partially cut away to show the interlocing structure for one of the split die portions; and FIG. 23 shows one of such segments in its compressed state during bonding of the wire turns;

FIG. 25 is a perspective view of an apparatus for pre-winding the core material of the present invention;

FIG. 26 is a schematic representation of the annealing operation of the pre-wound core material of FIG. 25;

FIG. 27 is a partially cut-away perspective view of a core sleeve being installed in the core insulation tube of the present invention;

FIG. 28 is a fragmented view showing the ends of the core sleeve of FIG. 27 being joined;

FIGS. 28A illustrates an arrangement whereby the use of the core sleeve of FIG. 28 may be eliminated for a core fabricated from sufficiently thick core material;

DETAILED DESCRIPTION OF THE PREFERRED EMBODIMENTS

FIGS. 1 through 41 of the drawings depict various preferred and alternate embodiments of the present invention for purposes of illustration only. One skilled in the art will readily recognize from the following discussion that still other alternate embodiments of the structures and methods illustrated herein may be employed without departing from the principles of the invention described herein.

Figure 1:
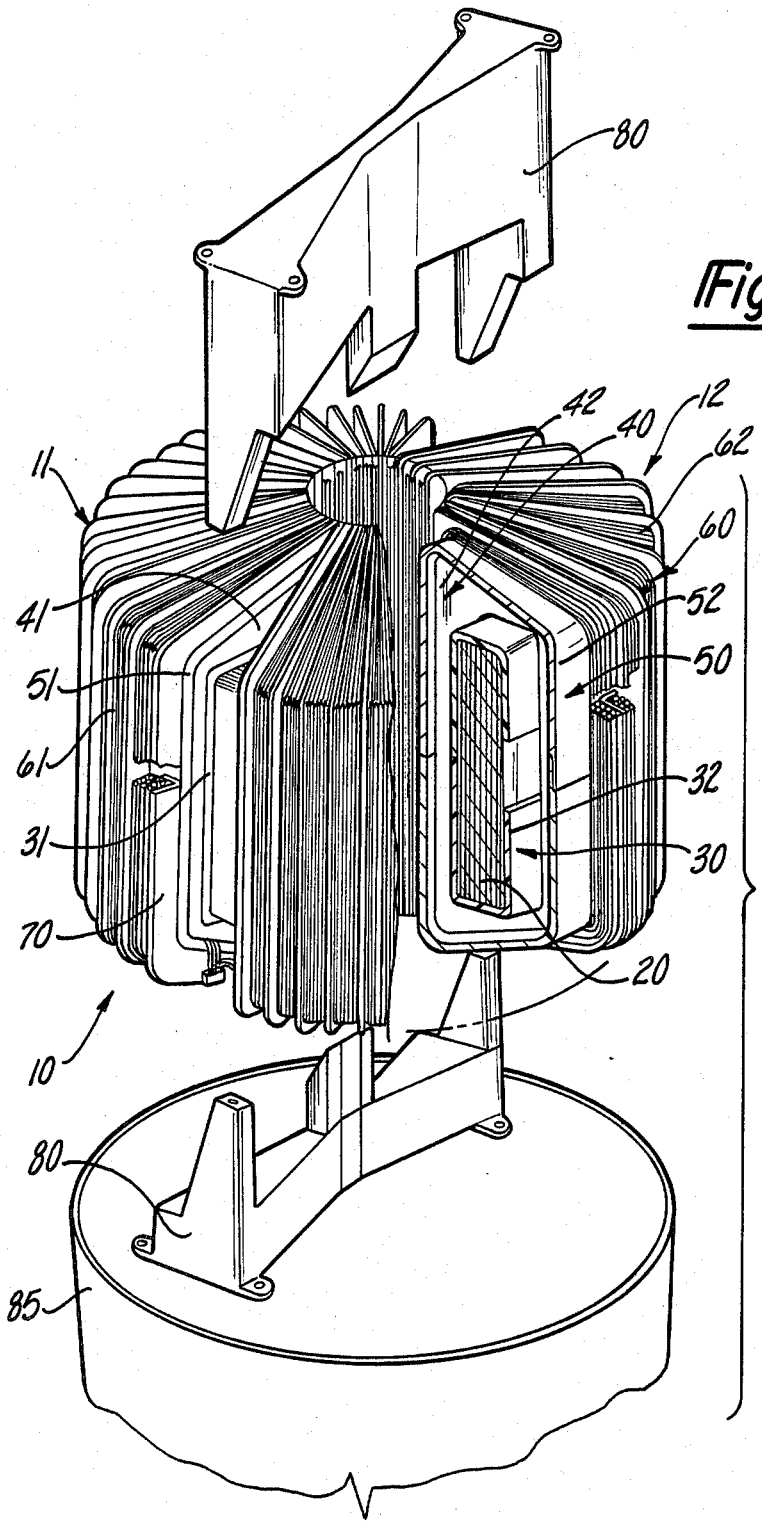
FIG. 1 is a partially cut-away, partially exploded, perspective view of a preferred toroidal electrical transformer according to the present invention.
Figure 2:
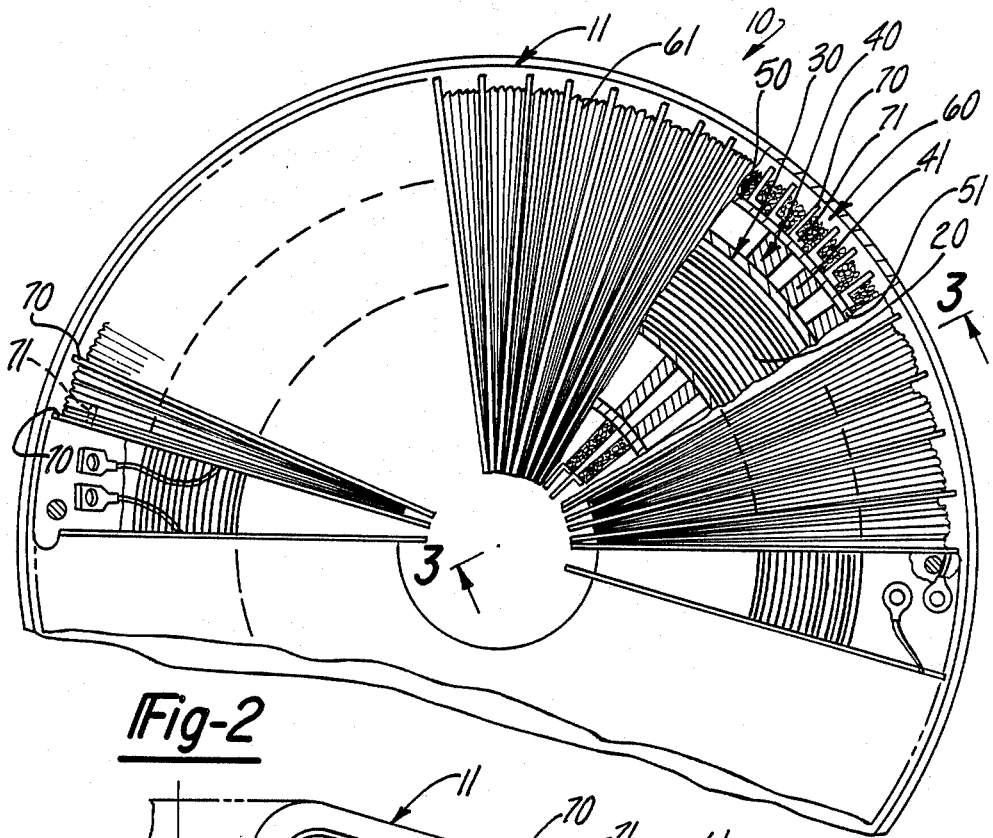
FIG. 2 is a partially cut-away top view of the toroidal electrical transformer of FIG. 1.
Figure 3:
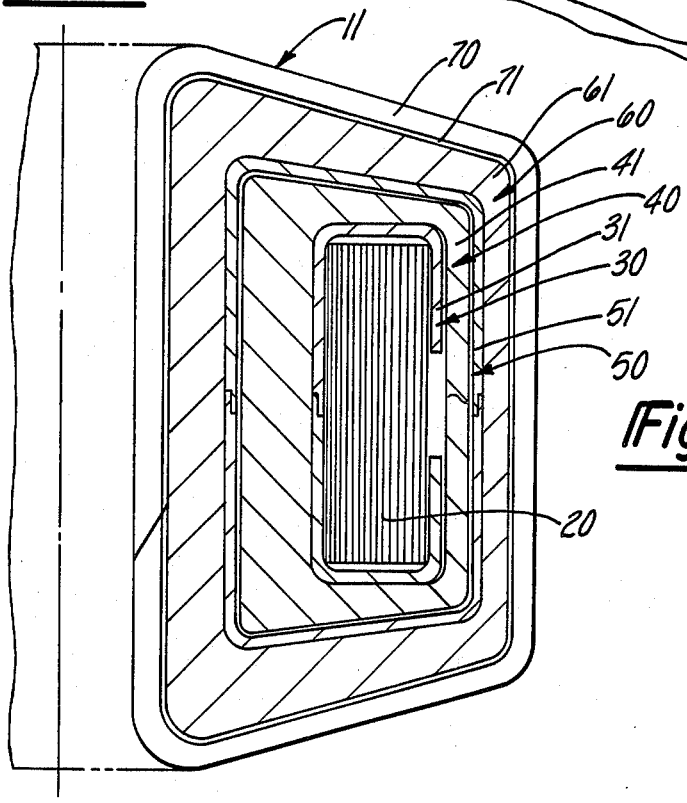
FIG. 3 is a partial cross-sectional view of the toroidal electrical transformer taken along line 3—3 of FIG. 2.

FIGS. 1 through 3 illustrate a preferred toroidal electrical transformer 10 including a continuously wound, toroidal or annular core 20 disposed within a core insulation tube 30. A low voltage coil or winding 40 surrounds the core insulation tube 30 and is encased by a high/low insulation barrier 50, which is in turn surrounded by a high voltage coil or winding 60.

The high voltage winding 60 is preferably made up of two sections 61 and 62, each including a plurality of winding bundles or segments continuously wound from a common wire and connected by loops of said common wire, e.g., twenty 2½% voltage segments in each of said sections. At least the segments of the high voltage winding 60 near the ends of the sections 61 and 62 are preferably separated by inserts 70, around which said loops extend, for purposes of minimizing impulse stresses resulting from any non-linear voltage distribution to which the high voltage winding may be subjected, such as those encountered during high voltage impulses caused, for example, by lightning. Such inserts 70 may in some cases be required between all high voltage winding segments as shown in the drawings, or more than one insert may be required between each segment. The inserts 70 are preferably composed of a synthetic material, such as "MYLAR" or "KAPTON" for example, and are retained in place by thermo-formed cuffs 71 which extend circumferentially under the high voltage winding segments as shown in FIG. 2. Similarly, the preferred low voltage winding 40 is also made up of two sections 41 and 42, corresponding to the high voltage winding sections 61 and 62. Such preferred low voltage coil sections 41 and 42 may each include either a singular winding conductor, bifilar or multifilar parallel conductors in an interleaved configuration, one of such parallel conductors for each voltage winding, as is explained in detail below. In the preferred embodiment, as shown in the drawings, the high voltage winding sections 61 and 62 and the low voltage winding sections 41 and 42 each extend circumferentially through an arc of approximately 165 degrees on each side of the transformer 10. Correspondingly, the core insulation tube 30 and the high/low insulation barrier 50 are each formed in two-section pairs 31, 32 and 51, 52, respectively, with each of the sections extending circumferentially through an arc of approximately 165 degrees on each of the two sides of the preferred transformer 10. Thus, the low voltage coil 40 is preferably disposed within the high voltage coil 60, and the two coils preferably encompass approximately 165 degress of the circmferential length of the toroidal or annular core 20.

The term "continuous" as used herein in connection with the high voltage winding or coil 60, and the sections 61 and 62 thereof, includes a preferred configuration wherein the wedge-shaped segments and the connecting loops are wound and formed from a single wire or conductor that is continuous over the length of each of the high voltage coil sections 61 or 62, or in other words, over substantially one-half of the toroidal transformer 10. Such term "continuous" also refers to various alternate configurations of the high voltage coil 60, wherein at least each wedge-shaped segment is wound from such a continuous wire or conductor.

With respect to the low voltage winding or coil 40, and the sections 41 and 42 thereof, the term "continuous" includes the above-mentioned preferred singular, bifilar or multifilar arrangements, wherein the conductor is continuous over the length of each of the low voltage coil sections 41 or 42, or over the length of each of the interleaved windings for each section, as is described in detail below in connection with FIG. 14. Thus in such preferred embodiment, the low voltage coil is continuous over substantially one-half of the toroidal transformer 10. The term "continuous" also includes any of several alternate low voltage coil structures wherein at a minimum the low voltage conductor, whether singular, multifilar, or otherwise, and whether interleaved or not, is continuous over at least three turns thereof.

The term "continuous", as used with reference to the magnetic core 20, includes such core structures wound from a single or multifilar group of ribbon-like strips of continuous core material as well as a successive, serially-connected group of core material strips, wound-in successively to form increasingly large diametric regions of the core 20.

The terms "toroidal" or "annular" as used herein in connection with the high and low voltage coils 60 and 40, respectively, and in connection with the magnetic core 20, refer to the configuration of a torus generated by the revolutions of any of a number of regular or irregular shapes about an external axis. The various preferred and alternative structures and configurations of the high and low voltage windings or coils 60 and 40, respectively, and of the magnetic core 20 are described in detail below.

Figure 4:
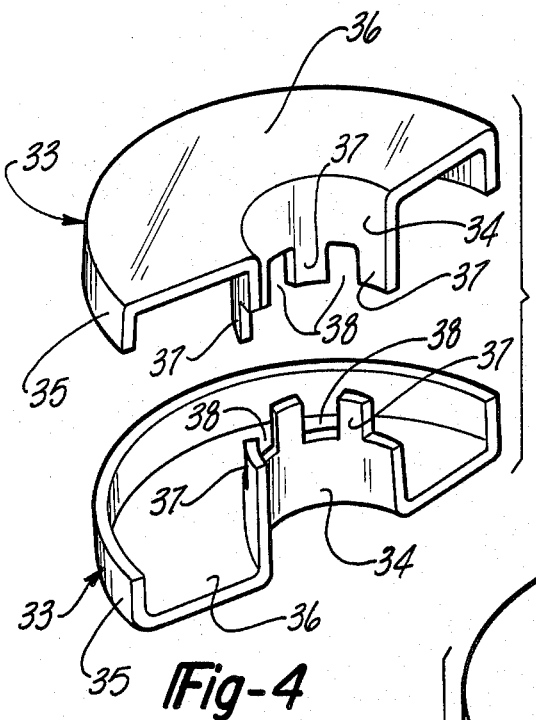
FIG. 4 is an exploded perspective view of one section of the preferred core insulation tube of the present invention.
Figure 4A:
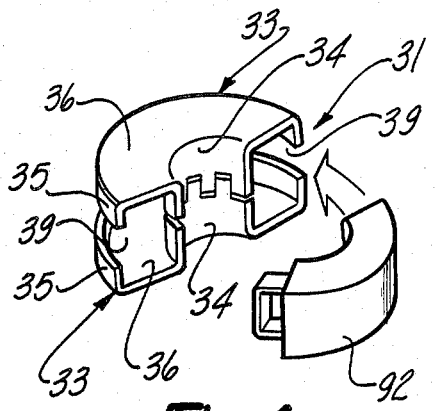
FIG. 4A is a perspective view of an assembled section of the core insulation tube of the present invention and a spreading tool therefor.

FIGS. 4 and 4A represent detail views of the section 31 of a preferred core insulation tube 30. Although the section 31 is shown in FIGS. 4 and 4A for purposes of illustration, one skilled in the art will appreciate that the section 32 is identical to the section 31.

The core insulation tube section 31 includes a pair of upper and lower half-sections 33 which are preferably molded from a synthetic material and are identical in configuration but inverted with respect to each other. Thus the four identical half-sections required to form the core insulation tube 30 may all be molded from a single mold. The half-sections 33 are preferably molded from a high-strength, glass-filled synthetic material, such as polyester, nylon, or epoxy, for example.

The half-sections 33 of the core insulation tube 30 each include inner and outer walls 34 and 35, respectively, extending in an axial direction from a base portion 36. One or more interlocking protrusions preferably in the form of teeth or tabs 37 protrude axially from the inner wall 34, with a corresponding number of circumferential spaces 38 between adjacent teeth 37. The teeth or protrusions 37 and the spaces 38 are oriented such that when the identical upper and lower half-sections 33 are joined together to form the section 31, as shown in FIG. 4A, the teeth 37 intermesh to prevent relative circumferential displacement of the inner walls 34 of the upper and low half-sections 33. The teeth 37 have vertical edges oriented along radius lines passing through the center of the transformer 10, thereby providing for a flush, interference-free engagement of the upper and lower teeth 37.

The axial length or height of each inner wall 34 and the teeth 37 is preferably greater than that of the outer leg 35, thereby forming an axial gap 39 around the periphery of the core insulation tube 30 as is illustrated in FIG. 4A. The purpose of the axial gap 39 will be described in detail below in connection with the core wind-in process illustrated in FIGS. 29 through 31. The teeth 37 are preferably of an axial length or height such that the sections 31 and 32 may be axially collapsed to a height allowing easy insertion into the toroidal opening or arcuate elongated passage formed by the low-voltage coil sections 41 and 42, as will be described below. After such insertion, the half-sections 33 may be spread by means of a suitable spreading device such as the wedge-shaped spreader tool 92 shown in FIG. 4A, for example. The spreading of the half-sections 33 after insertion into the low voltage coil section 41 allows the core insulation section 31 to substantially conform to the inside of the low voltage coil section 41 thus providing sufficient space in the arcuate elongated passage for winding in the core 20, as will be described later in this discussion. Such spread position may be maintained by providing detents formed on the teeth 37, or by other means known to those skilled in the art.

Figure 5:
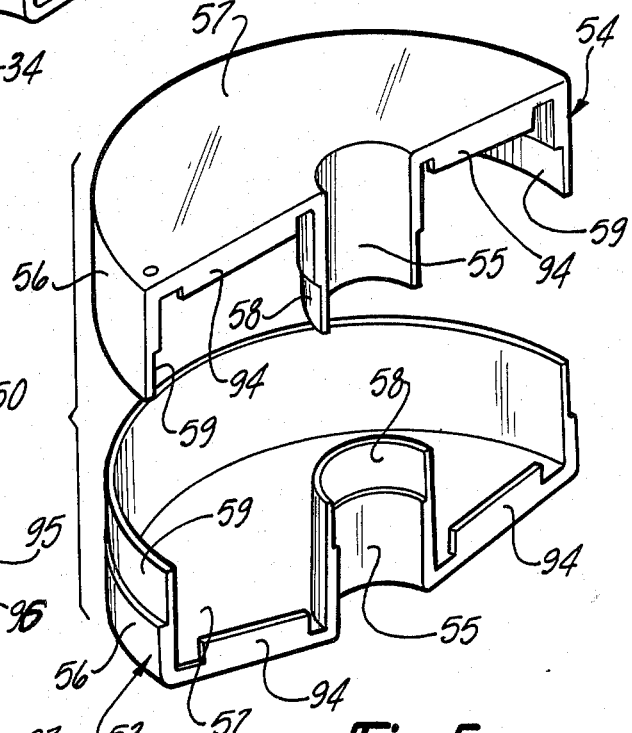
FIG. 5 is an exploded perspective view of one section of the preferred high/low insulation barrier of the present invention.

FIG. 5 shows the preferred section 51 of the high/-low insulation barrier 50, for purposes of illustration. One skilled in the art will readily understand that section 52 is identical to section 51. The section 51 of the high/low insulation barrier 50 includes a pair of upper and lower half-sections 53 and 54, respectively, which like the half-sections 33 of the core insulation tube section 31, may be molded from a suitable reinforced synthetic material. A set of inner and outer walls, 55 and 56, respectively, extend axially from each of the base portions 57 and in the preferred embodiment include opposite-oriented, radially recessed end portions 58 and 59, respectively.

When the upper and lower half-sections 53 and 54 are axially joined together over the low voltage coil 41, the respective preferred recessed end portions 58 and 59 of the inner and outer walls 55 and the overlap in a general flush, mating relationship, thereby providing insulation protection to withstand electrical stresses occurring during high impulse voltages associated with the high voltage coil 60. The half-sections 53 and 54 must then be compressed axially, thereby allowing for assembly of the high voltage coil segments over the low voltage windings and the core insulation barrier subassembly.

The particular cross-sectional shapes of the generally toroidal or annular shaped core insulation tube 30 and high/low insulation barrier 50 correspond to the desired cross-sectional shapes of the toroidal or annular magnetic core 20 and high and low voltage coils 60 and 40, respectively.

Figure 6:
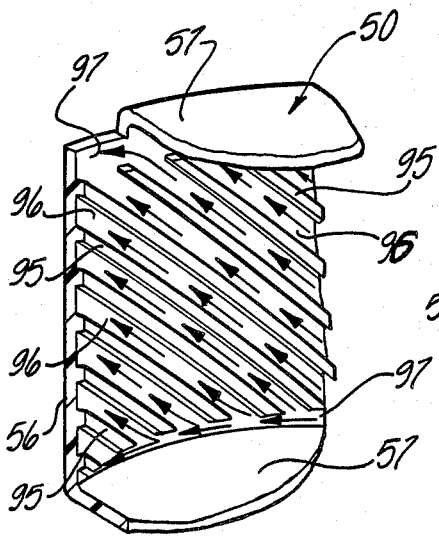
FIG. 6 is a fragmented perspective view of one of the insulation members of the preferred toroidal electrical transformer, illustrating a preferred cooling fluid channel structure.

FIG. 6 illustrates a broken-away portion of the high/-low insulation barrier 50 including a preferred but not necessary internal wall structure of the present invention. The wall structure shown in FIG. 6 and the related discussion herein are equally applicable to the core insulation tube 30.

Transformers of the type disclosed herein frequently employ oil or other fluids, either liquid or gaseous, for cooling their components during operation. Such cooling fluid is typically an electrical grade insulating oil. The high/low insulation barrier 50 in FIG. 6 includes a number of ridges 95 molded into the internal side of the outer wall 56. The ridges 95 may be inclined, spiral, involute, or the like, and form a plurality of cooling fluid branch channels 96 therebetween. The ridges 95 are interrupted short of the base portions 57 and thereby form common header channels 97 at the upper and lower peripheries of the outer wall 56. The branch channels 96 and the header channels 97 act as conduits for the convective flow of the cooling liquid. The configuration of the ridges 95, being inclined or spiral, etc., imparts a convectively induced circulating motion to the cooling fluid flow throughout the inside of the high/low insulation barrier 50, as illustrated by the flow arrows in FIG. 6. Such circulating motion promotes both cooling of the components and uniform temperature distribution throughout the transformer.

Figure 7:
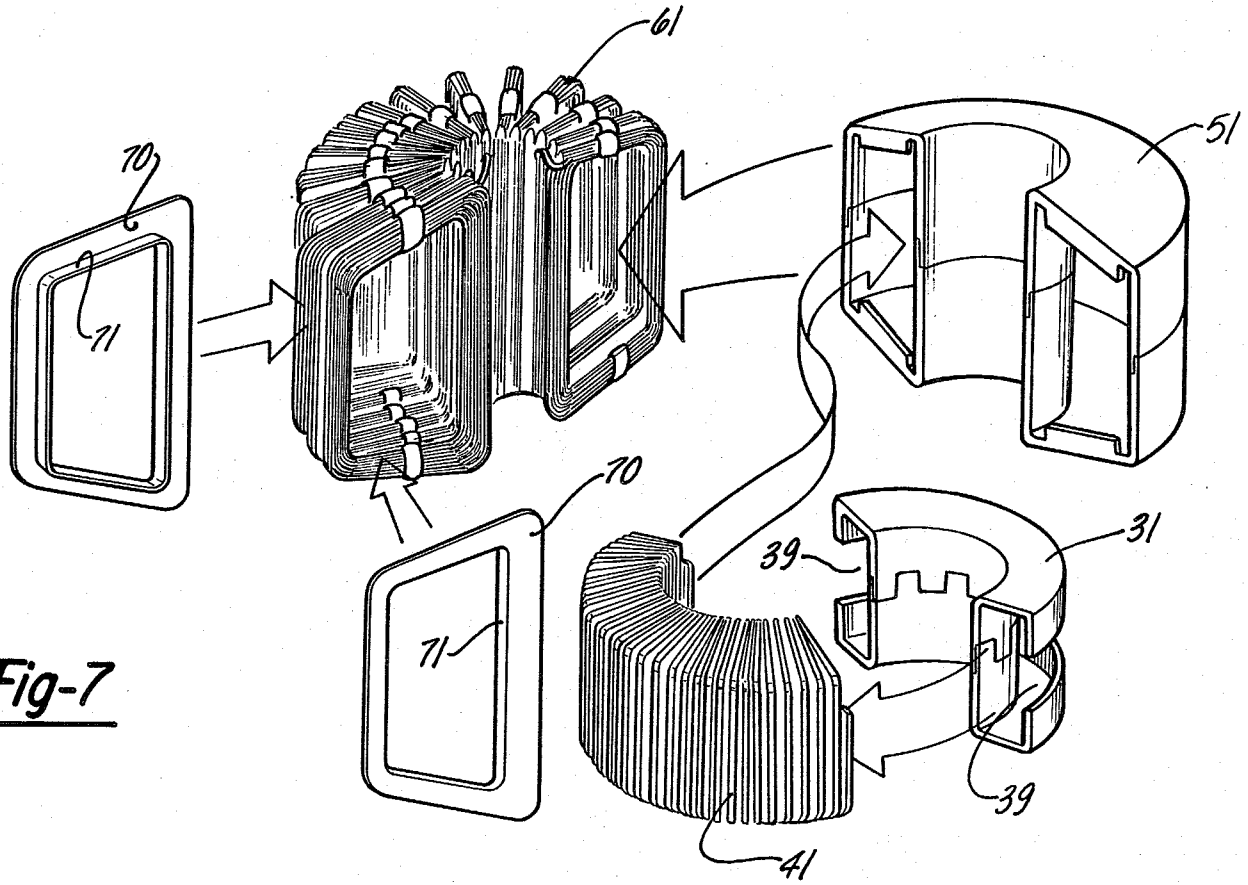
FIG. 7 is a schematic view illustrating the preferred assembly of the major transformer components prior to installation of the magnetic core.

As is shown schematically in FIG. 7, the corresponding sections of the above-described components are assembled into two preferred transformer half-portions or sections 11 and 12, each extending circumferentially through an arc of approximately 165 degrees as described above. The preferred transformer portions 11 and 12, when combined, thus form a substantial portion of a torus made up of two symmetrical halves with a circumferential space of approximately 15 degrees therebetween on each side. One of the primary purposes for the above-described construction is to form an arcuate elongated passage for allowing the core 20 to be continuously wound in place in a toroidal or annular configuration as is illustrated in FIGS. 1 through 3 and described in detail below. Once the core wind-in operation is completed, the transformer assembly is retained in its proper configuration by means of supporting blocks 80 (see FIG. 1), which maintain an equal spacing between the half-portions 11 and 12 on both sides of the transformer 10. The transformer assembly is then installed in a suitable containment structure such as the tank or housing 85 shown in FIG. 1. Various additional features will become readily apparent from the following description of the methods employed in the manufacture of a toroidal electrical transformer and the components thereof according to the present invention.

Figure 8:
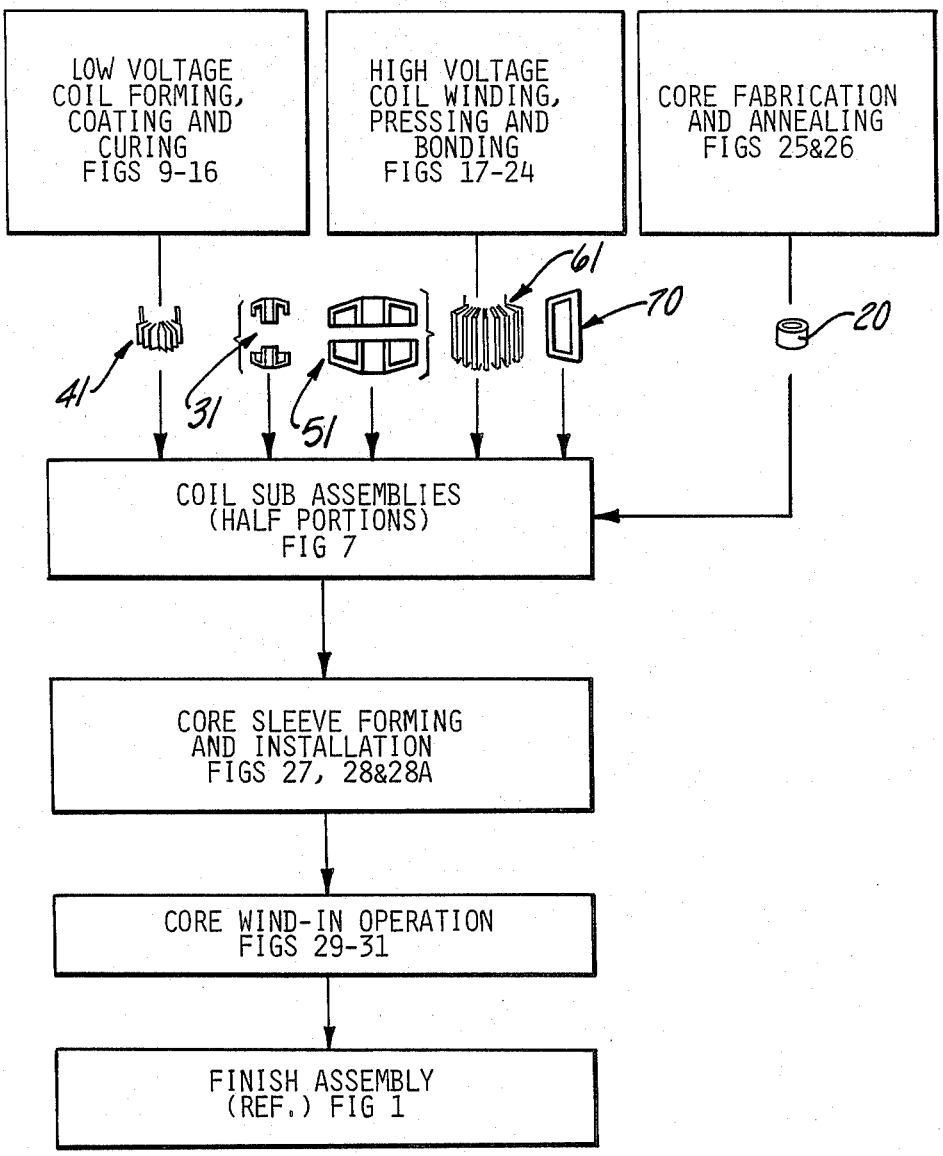
FIG. 8 is a block diagram, generally illustrating the preferred method of manufacturing a toroidal electrical transformer according to the present invention.
Figure 9:
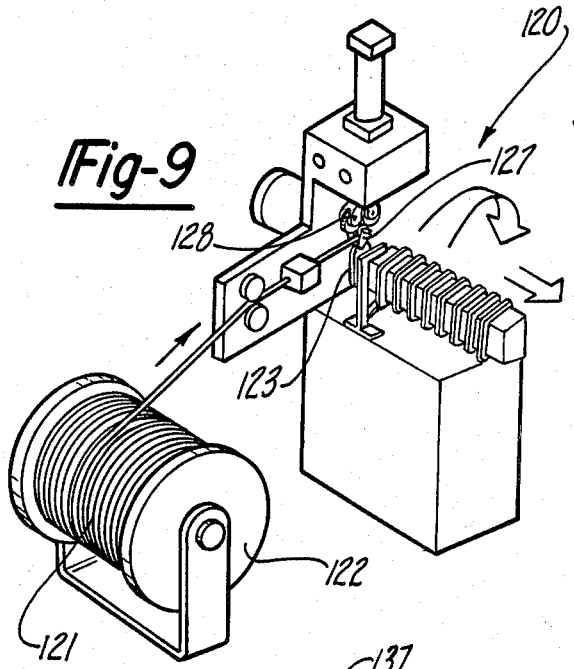
FIG. 9 is an overall view of a preferred low voltage coil forming and winding apparatus used in connection with the present invention.

FIG. 8 illustrates, in block diagram form, an overview of the major operations involved in the preferred method of manufacturing the toroidal electrical transformer 10. Although for purposes of illustration, the reference numerals in FIG. 8 and in the following discussion relate to the transformer half-portion 11, the structure and production methods of the transformer half-portion 12 are preferably identical to those of the transformer half-portion 11.

The low voltage coil section 41 is preferably wound from continuous conductor stock with each turn being formed into a wedge shape to provide the toroidal or annular configuration. Preferably, each turn is formed with a generally constant cross-sectional area throughout. The formed coil is then coated with insulation, and the insulation is cured to finish the coil section 41. The above low voltage coil producing steps are described in detail below in connection with FIGS. 9 through 16 of the drawings.

The low voltage coil 41 is then positioned onto the exterior of the pre-assembled core insulation barrier 31 and encased within the upper and lower halves of the high/low insulation barrier section 51 as is shown schematically in FIG. 7. The sub-assembly is then ready for addition of the high voltage coil section 61.

The high voltage coil section 61 is preferably wound from a continuous wire and formed into a number of wedge-shaped bundles or segments. The segments are then compressed, and the individual turns of wire in each segment are bonded together to form a tightly wound continuous coil with a greater number of turns of the wire per unit cross-sectional area of the coil than existed before the segments were compressed. Such increase in the number of turns per unit cross-sectional area of the coil maximizes the use of the volume of the toroidal or annular space and thereby increases the efficiency of the transformer. These operations are described in detail below in connection with FIGS. 17 through 24.

As is illustrated schematically in FIG. 7, the inserts 70 are located at each end of the high voltage coil section 61 and between adjacent segments with the cuffs 71 extending into the toroidal openings in the segments. The high voltage coil section 61 and the inserts 70 are then positioned onto the exterior of the high/low insulation barrier section 51 to complete the operation of forming the half-portion 11 prior to the winding in of the core 20.

The core material, which is of a relatively thin, ribbon-like configuration is preferably pre-wound into a tight coil and automatically severed at a prescribed length determined by the size of the transformer being produced. The coil is then restrained and annealed to relive its internal stresses, as is illustrated in FIGS. 25 and 26. The resultant structure is a pre-wound, coil-shaped core 20 which is ready for winding into the above-described transformer half portions 11 and 12.

The remaining steps in the production process include forming and installing a core sleeve from a blank of core material, if deemed to be necessary for the particular core material being used (FIGS. 27 and 28); the winding of the pre-formed, pre-annealed core 20 into the arcuate elongated passage through the interdisposed high and low voltage coils 60 and 40, respectively, (FIGS. 29 through 31); and the finished assembly steps of installing the supporting blocks, electrically connecting the respective sections of low voltage coil 40 and the high voltage coil 60, and mounting the assembly in a suitable housing structure (see FIG. 1).

FIGS. 9 through 13 illustrate a preferred winding and forming apparatus 120 for fabricating the low voltage coil sections 41 and 42, which may be composed of suitable conductor material such as aluminum or copper. The preferred aluminum coil may be fabricated from preshaped EC grade conductor stock of the redraw type or from other suitable conductor stock known to those skilled in the art. The coil feedstock 121, which may be round, square, or other desirable cross-section, is fed from a reel 122 onto a forming mandrel 123 having a cross-sectional shape corresponding to the desired cross-sectional shape of the toroidal low voltage coil 40. The forming mandrel 123, which is secured to a rotating shaft 124, includes a forming die plate 125 and an axially-projecting shoulder portion 126 for receiving the feedstock 121. The feedstock 121 is engaged and pressed into the desired cross-sectional shape by means of a conical pressure roller 127 and a vertically reciprocating cylindrical pressure roller 128, which cooperate with the forming mandrel 123 to forcibly deform the feedstock 121 into the desired shape as the shaft 124 rotates. A conical backing roller 129 provides a counteracting force against the opposite side of the forming mandrel 123 to balance the force exerted by the conical pressure roller 127, thereby providing the lateral stability required for the forming operation. A guide 131 directs the formed coil onto a storage mandrel 132 that rotates in unison with the forming mandrel 123, thereby producing a continuously wound coil configuration which is wound around the storage mandrel 132 as the process continues.

The cylindrical roller 128 is free-floating between the conical pressure roller 127 and the conical backing roller 129 in the preferred embodiment and is supported vertically by a pair of cylindrical back-up rollers 137. The cylindical back-up rollers 137 are rotatably attached to the yoke member 138. A pressure piston, which may be a pneumatic or hydraulic device, urges the cylindrical back-up rollers 137 against the cylindrical roller 128, which in turn forcibly engages the conductor feedstock 121 during the forming operation. By supporting the cylindrical roller 128 between the conical rollers 127 and 129, its contact point is maintained directly between the lines of contact of the conical rollers 127 and 129. The use of the two spaced-apart cylindrical back-up rollers 137 provides clearance for the conical rollers 127 and 129 as the cylindrical roller 128 oscillates in engagement wth the forming mandrel 123 and the conductor feedstock 121. Preferably, the sides of the cylindrical roller 128 are slightly concave, thereby limiting the contact with the conical rollers to only the rim portion of the cylindrical roller 128 in order to minimize scuffing and wear resulting from differences in the surface speed of the rollers. Alternatively, a single cylindrical roller (not shown) may be rotatably supported by a yoke member and may be sized large enough to avoid interference between its axis and the conical rollers 127 and 129. Such a single cylindrical roller would also have concave sides to minimize scuffing and friction therebetween. In such an arrangement, however, the cylindrical roller would have to be reciprocable laterally so as to maintain its pressure point between the lines of contact of the conical rollers.

Figure 11:
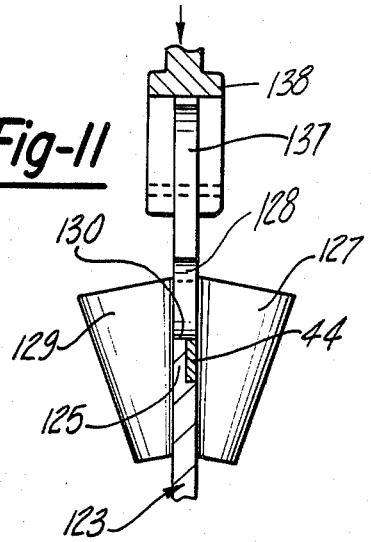
Figure 12:
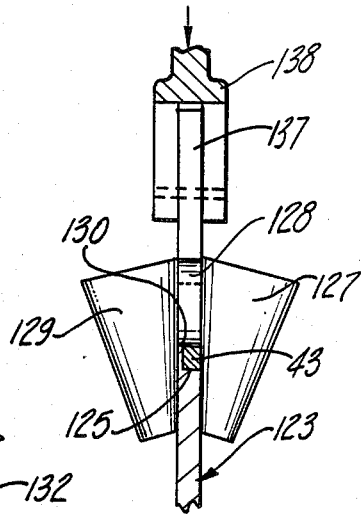
Figure 10:
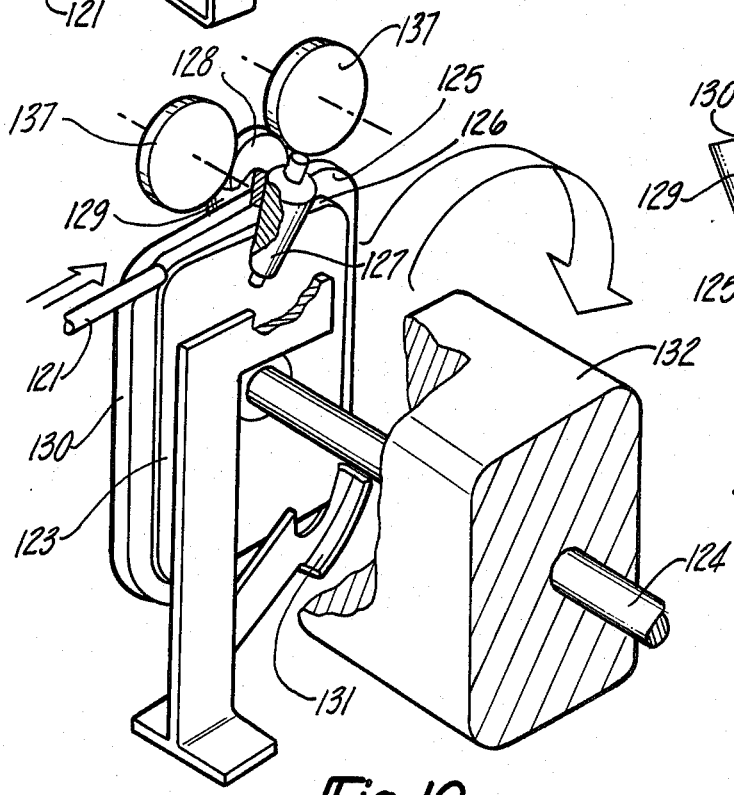
FIG. 10 is a detail view of the low voltage coil forming portion of the apparatus of FIG. 9.
Figure 13:
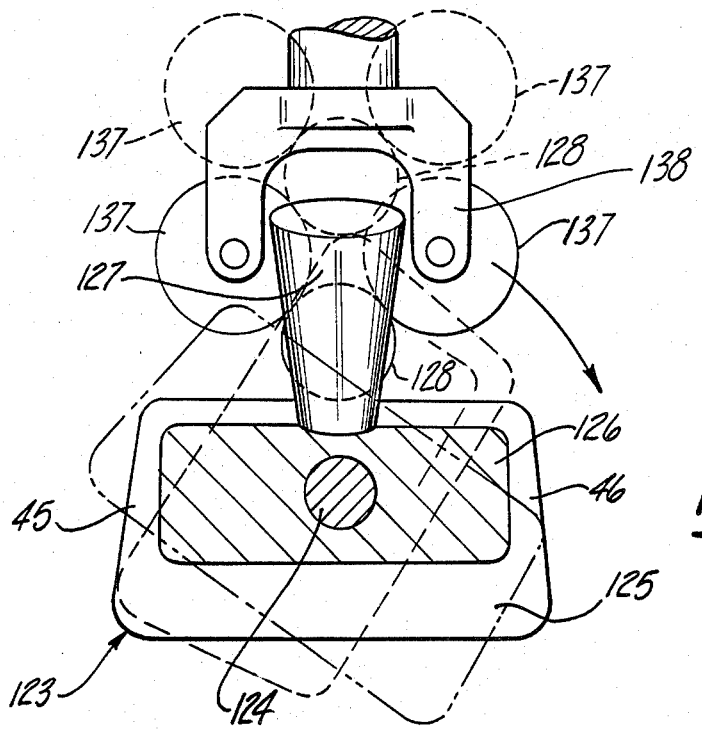
FIG. 13 is an end view of the low voltage coil forming portion of the apparatus of FIG. 9, illustrating various roller and mandrel positions during the coil forming operation.
Figure 14:
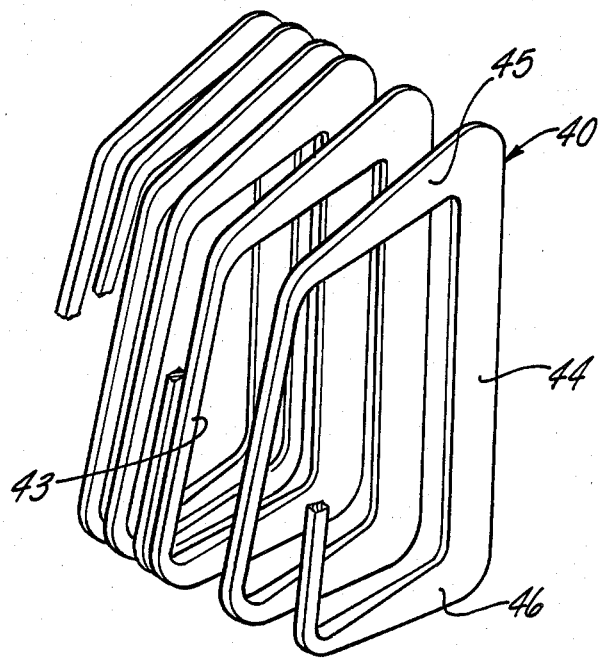
FIG. 14 is a detail view illustrating a few interleaved turns of two finished low voltage coil lengths.

FIGS. 11, 12, and 13 illustrate schematically the relationship of the forming components during various stages of rotation of the forming mandrel 123, and FIG. 14 shows a number of wedge-shaped interleaved turns of the formed low voltage coil 40 as discussed in detail below. In FIG. 11, an inner leg 44 of the low voltage coil 40 is being formed. As may be best seen in FIG. 14, the inner leg 44 is wide in the radial direction and thin in the circumferential direction, said directions being relative to the toroidal or electrical transformer 10. Thus, in FIG. 11 the cylindrical roller 128 is in following engagement with the edge 130 of the forming die plate 125 of the forming mandrel 123. Also as is shown in FIG. 11, the axial thickness of the forming die plate 125 is large compared to the overall thickness of the forming mandrel 123 thereby forming a thin cavity in which the conductor feedstock 121 is forced. Thus, the feedstock 121 is forcibly compressed and deformed into a generally quadrilateral space having a high height-to-width aspect ratio, thereby forming the inner leg 44 of the low voltage coil 40.

In FIG. 12, the forming mandrel 123 has rotated 180 degrees from the position shown in FIG. 11 in order to form an outer leg 43 of the low voltage coil 40. As may be best seen in FIG. 14, the preferred outer leg 43 is generally quadrilateral in cross-section, with a low height-to-width aspect ratio. Acordingly, in FIG. 12, the thickness of the forming die plate 125 is thin compared to the overall thickness of the forming mandrel 123, thereby forming a thicker cavity into which the conductor feedstock 121 is forced.

As the forming mandrel 123 rotates from its FIG. 12 position to its FIG. 11 position, as is shown in part in the schematic representation in FIG. 13, the cylindrical roller 128 raises and lowers in following engagement with the corners of the forming mandrel 124. Also, the radial excursion of the die forming plate 125 increases to form the wedge-shaped upper portion 45 and, subsequent to forming the inner portion 44, decreases to form the wedge-shaped lower portion 46.

The winding and forming process described above continues until a predetermined number of low voltage turns have collected on the storage mandrel 132, at which time the conical pressure roller 127, the cylindrical pressure roller 128, and the conical backing roller 129 are indexed away from the forming mandrel 123 thereby allowing the fabrication of a cross-sectionally unformed terminal portion on the ends of the formed coil. Finally, the feedstock 121 is automatically severed, the formed coil is removed, and the process is repeated to form another length of low voltage coil.

In forming the preferred low voltage coil 40, two lengths of coil formed as described above are intertwined or interleaved into a generally double-spiral, or double-helix, configuration as is illustrated in FIG. 14 to form one of the coil sections 41 or 42. Each of such coil lengths in the low voltage coil section 41 is connected in series to a corresponding coil length in the low voltage coil section 42 upon final assembly of the toroidal transformer 10. Each of such lengths is designed for one-fourth of the total low voltage. Thus, each of the resultant sections 41 and 42 of low voltage coil 40, when connected as described above, comprises two parallel toroidal coil lengths, interleaved in a double-helix configuration, each of said sections 41 and 42 being designed to carry one-half of the total low voltage value of the transformer. One end of each of such parallel coil lengths is connected to one of two low voltage transformer terminals, and the opposite end of each coil length is connected together to the common neutral terminal of the transformer. This connection facilitates a low voltage electrical output (or input), with one half of such voltage being above neutral and one-half below neutral for ease of single-phase multivoltage wiring. One reason for intertwining or interleaving the parallel lengths low voltage coil sections 41 and 42, as described above, is that if only a 120 volt load, for example, is applied across one of the low voltage terminals and the neutral terminal, a balanced ampere-turn relationship will exist between the loaded low voltage 120 volt coil section and the fully series-connected winding segments of the entire length voltage coil 60.

If the low voltage coil 40 were to be fabricated in a non-interleaved configuration, with only a single half-voltage coil length in each coil section 41 or 42, and with all of the high voltage coil segments of the entire high voltage coil 60 being connected in series, an application of a half-voltage load (e.g., 120 volts) to one of such low-voltage coil sections 41 or 42 would result in an excessively high circuit impedance. This is because one-half of the series-connected high voltage coil 60 would be dimensionally far removed from the low voltage coil section being used. If such a non-interleaved low voltage coil configuration is desired, however, a balanced ampere-turn relationship may be obtained by winding the high voltage coil 60 into two full voltage (e.g., 7200 volts per each coil section 61 or 62) and then simply connecting the coil sections 61 and 62 in parallel, thus obtaining good inductive coupling between each high voltage coil section 61 or 62 and its associated non-interleaved low voltage coil section 41 or 42. In such a case, one of the transformer sections 11 or 12 would provide transformation of one-half the output voltage (e.g. 120 volts) one side of neutral, with the other transformer section providing equal transformation on the opposite side of neutral.

Figure 36:
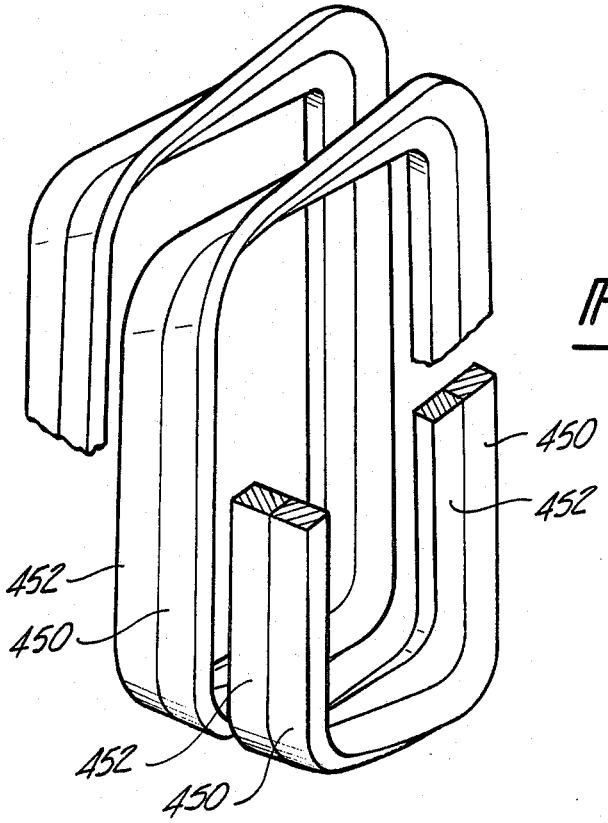
FIG. 36 is a partially fragmented view of a few representative turns of an alternate low voltage coil structure wound in a generally bifilar arrangement wherein the low voltage coil is wound from a pre-insulated conductor to form approximately wedge-shaped turns of said coil.
Figure 37:
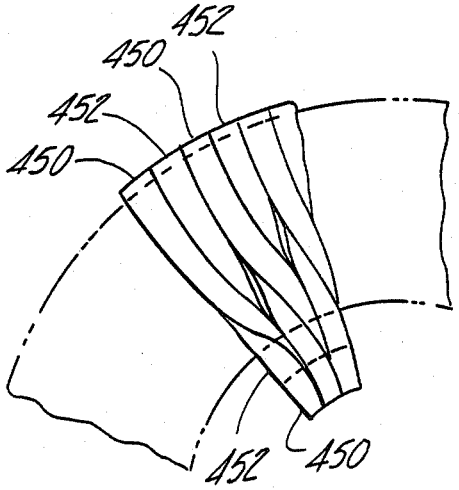
FIG. 37 illustrates a few turns of the low voltage coil of FIG. 36 as installed on a core insulation tube of the invention.

Although it would be desirable to wind and form the low voltage coil 40, as described above, from pre-insulated conductor feedstock (e.g., anodized or film-insulated), it may not be possible in some cases to do so by the above-described method without damaging the insulation coating. Therefore, if bare conductor feedstock is used, the formed coil sections should be insulated after forming and winding. FIGS. 36 and 37, and the corresponding discussion below, illustrates an alternate low voltage coil structure and method of winding that is perhaps better suited for use with pre-insulated conductors.

Figure 15:
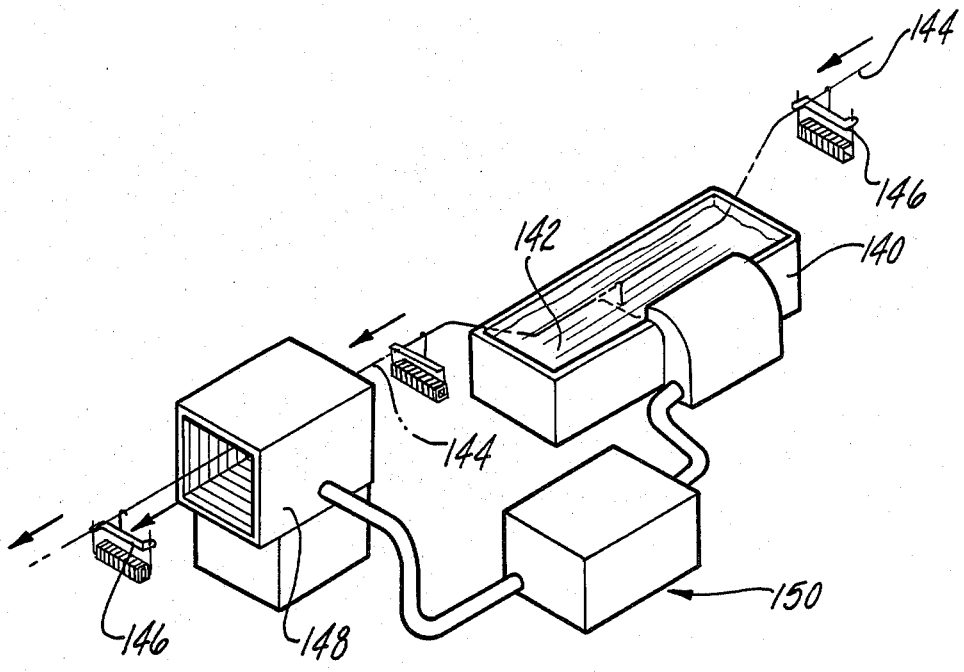
Figure 16:
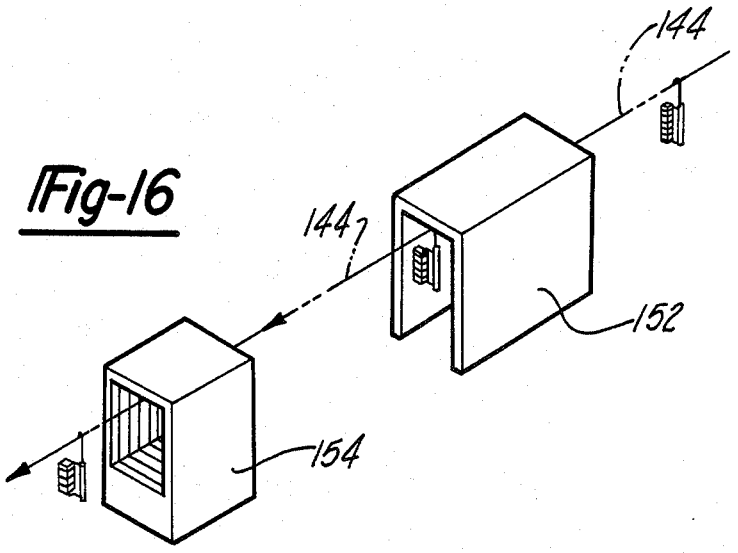

FIGS. 15 and 16 illustrate alternative or optional methods of applying insulation to the formed low voltage coil windings either before or after interleaving. In FIG. 15, a tank 140 contains a liquid insulation coating material 142, into which the coils are dipped and passed by means of a conveyer wire 144 with a series of hanger-type clamps 146 for retaining the formed coils. After the formed coils are dipped in the coating material 142, they are conveyed through a drying and curing apparatus 148 for solidifying the insulation. An insulation material recovery system, indicated generally by reference numeral 150 may be employed, if desired, to recycle insulation material vapors from the curing apparatus 148 to the tank 140.

In FIG. 16, an alternate powdered insulation material is electrostatically applied to the formed coils in an electrostatic spray bath 152. After application of the powdered insulation, the formed coils are cured in a curing oven 154.

Figure 17:
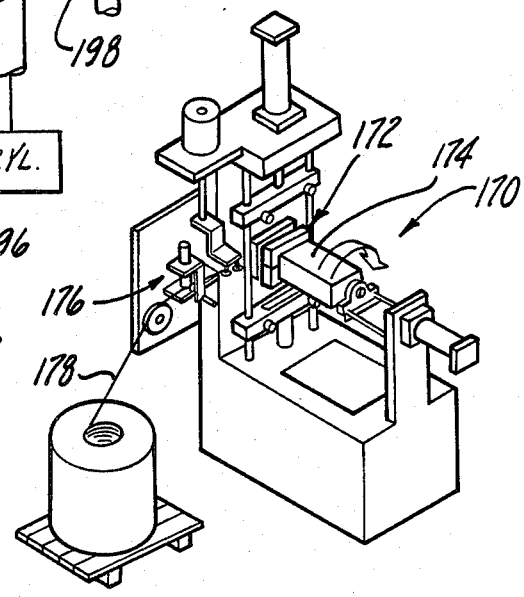
FIG. 17 is an overall perspective view of an apparatus for winding the high voltage coil and forming a plurality of wedge-shaped segments from a continuous wire.

FIGS. 17 through 24 illustrate a preferred apparatus and method for winding the high voltage coil 60 with a number of wedge-shaped segments preferably being formed and wound from a continuous wire. FIG. 17 shows an overall view of a preferred winding apparatus 170, which includes a winding and pressing assembly 172, a rotatable storage mandrel 174, and a wire guide assembly 176 adapted for feeding and guiding a continuous wire 178 into the winding apparatus 170. The preferred wire 178 is coated with an insulation material composed of a combination of a fully cured dielectric coating overcoated with a so-called "B" stage semi-cured thermosetting adhesive coating that is dry to the touch. The adhesive coating serves to bond the turns together and to enhance the insulating qualities of the insulation combination. Such insulation material as well as other similar materials are known to those skilled in the art.

Figure 18:
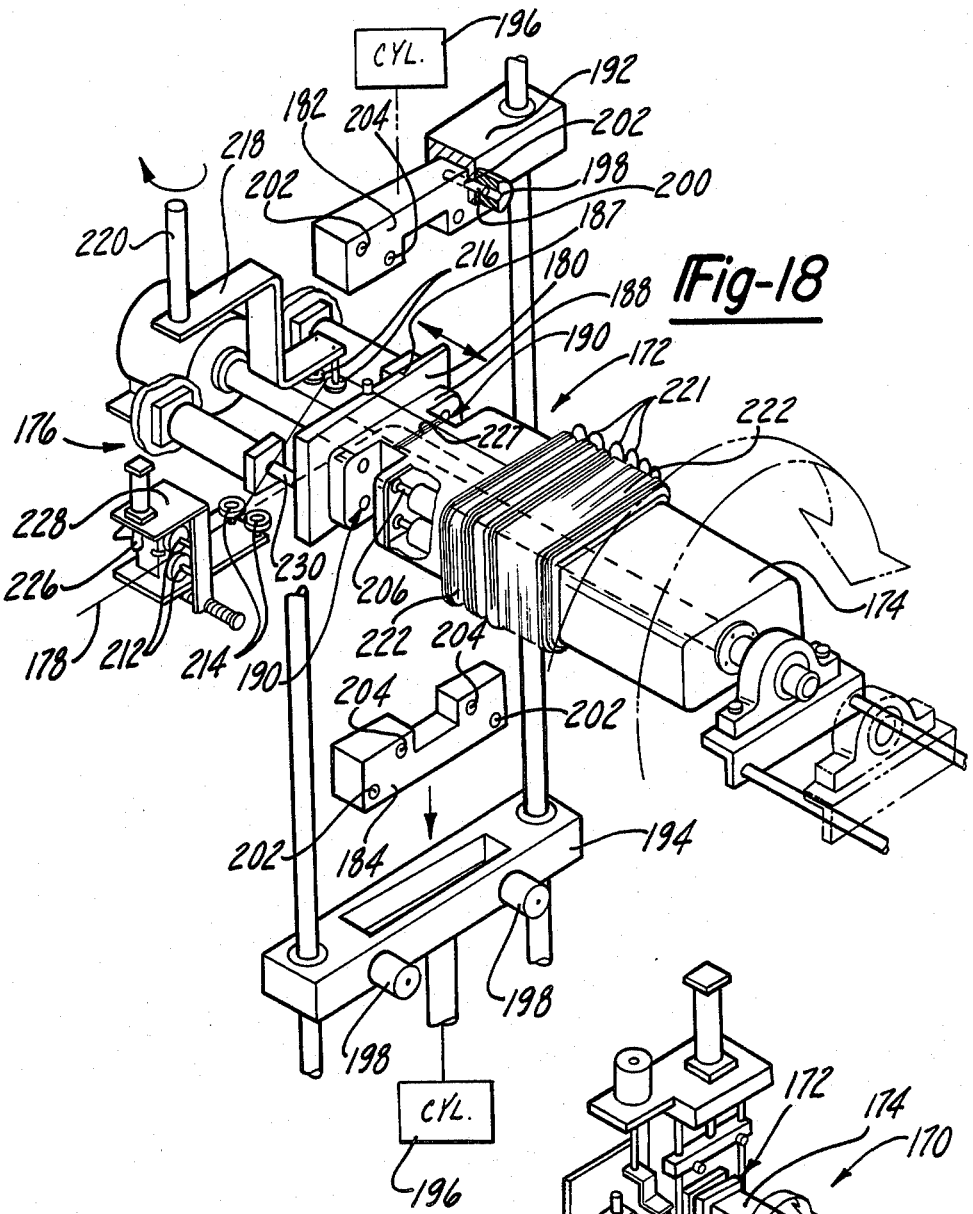
FIG. 18 is partially cut-away detail view of the winding and forming portion of the apparatus of FIG. 17, with the winding and forming dies in their open position.
Figure 19:
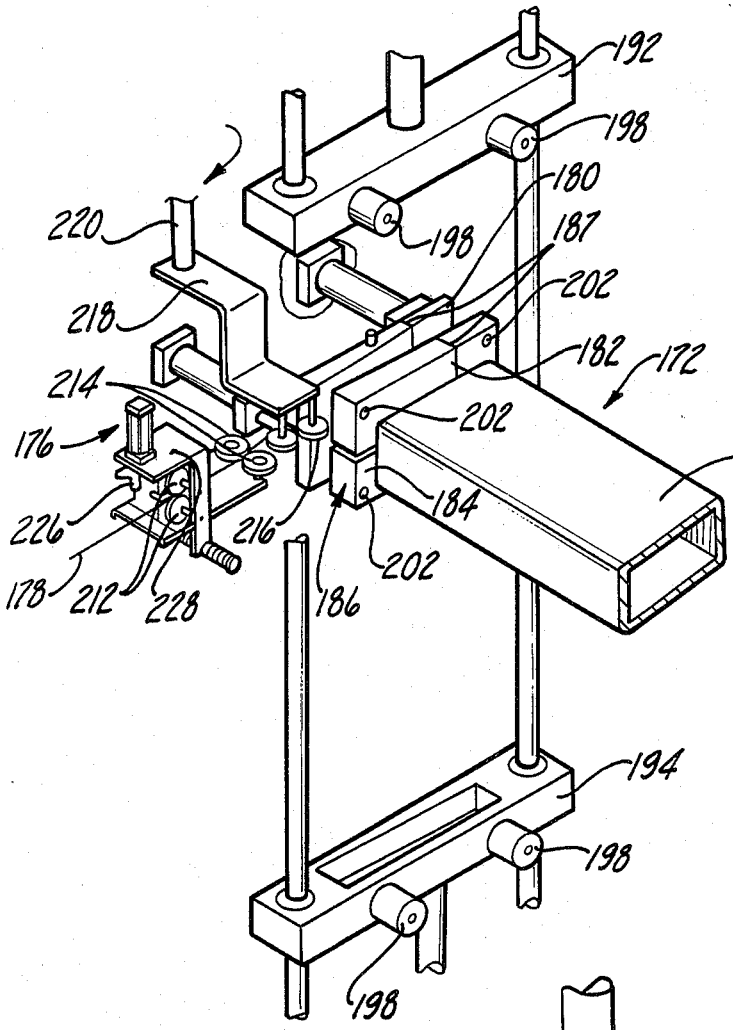
FIG. 19 is a partially cut-away view of the winding and forming portion of the apparatus of FIG. 17, with the winding and forming dies in their closed position.

As shown in FIGS. 18 and 19, the winding and pressing assembly 172 includes an integral winding form 180 and upper and lower portions 182 and 184, respectively of a split winding form 186. The integral and split winding forms 180 and 186, respectively, are operatively connected to a winding mandrel 188, which rotates in unison with the rotatable storage mandrel 174.

The upper and lower portions 182 and 184, respectively, of the split winding form 186 are movable into and out of interlocking engagement with a pair of cavities 190, formed by the winding mandrel 188 and the storage mandrel 174, by means of upper and lower carriers 192 and 194, respectively. The upper and lower carriers 192 and 194 are operated by a pair of hydraulic or pneumatic cylinders 196, or alternatively by any other suitable mechanical or electrical motion imparting operator known in the art. Each of the carriers 192 and 194 includes at least a pair of retaining devices 198 for selectively retaining or releasing the upper and lower portions 182 and 184 of the split winding form 186. The preferred retaining devices 198 each include a slidable armature 200 which extends to engage, or retracts to release, one of the retaining apertures 202 on each of the upper and lower form portions 182 and 184. The armatures 200 may be actuated by any suitable means such as an electric solenoid device, or by a hydraulic or pneumatic cylinder, for example. The preferred upper and lower form portions 182 and 184 also include a pair of locking apertures 204 adapted to receive a pair of locking pins 206 which are extendible from the storage mandrel 174 to retain the upper and lower forms portions 182 and 184 in position in the cavities 190.

Figure 22:
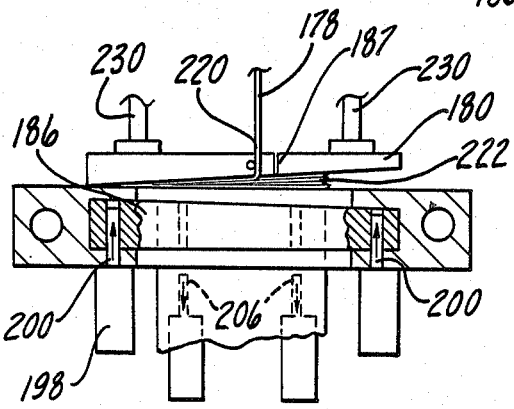

As may be best seen in FIGS. 18, 19 and 22, the above-described upper and lower carriers 192 and 194 thus operate to move the upper and lower form portions 182 and 184 into position in the cavites 190 under the force of the cylinders 196, where they are retained by the locking pins 206 and released by the armatures 200, at which point the upper and lower carriers 192 and 194 are retracted as shown in FIG. 19. When the upper and lower form portions 182 and 184 are to be moved out of the cavities 190, the upper and lower carriers 192 and 194 move into engagement therewith, the armatures 200 slide into the retaining apertures 202, the locking pins 206 are retracted from the locking apertures 204, and the upper and lower form portions 182 and 184 are moved away from the winding mandrel 188 by the upper and lower carriers 192 and 194. The purpose and timing of such movement of the upper and lower form portions 182 and 184 relative to the winding operation are discussed in detail below.

Figure 20:
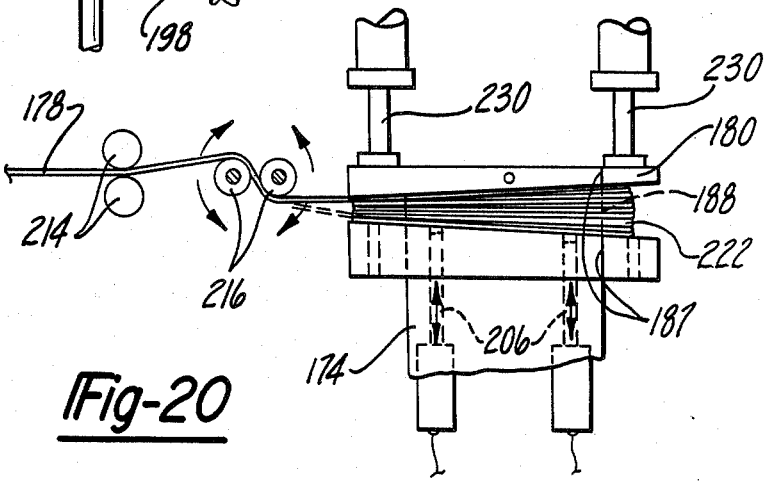
FIG. 20 is a top view of the winding and forming portion of the apparatus of FIG. 17, illustrating the wire guide assembly therefor.

The wire guide assembly 176, which may be best seen in FIGS. 18 through 21, includes vertical feed rollers 212, horizontal feed rollers 214, and a set of guide rollers 216 rotatably mounted on a guide arm 218 which is pivotally secured to a shaft 220. As the wire 178 is wound into the winding apparatus 170 between the wedge-shaped winding forms 180 and 186, the guide rollers 216 automatically oscillate in a lateral direction to direct the wire 178 onto the winding mandrel 188 in a generally uniform pattern, as shown in FIG. 20, thereby minimizing the gaps between wire turns and efficiently using the alotted space for each coil segment. As the winding of a particular coil segment 222 is nearly completed, an insulation piercer 226 (located near the feed rollers 212) makes a small cut in the insulation, thereby exposing the bare conductor. The winding then continues until the exposed portion of the wire is indexed in a position where it can be contacted by an electrode 227 after the wire segment 222 is compressed as is described below. The electrode 227 is located on the winding mandrel 188 (see FIGS. 18 and 23), and its purpose is explained below. The guide arm 218 and the guide rollers 216 pivot to the position shown in FIG. 21 to form the continuous loop portion 221 (see FIG. 18), with the above-described exposed portion therein, between each of the coil segments 222 and to allow for the compressing and bonding of the wire in the segments 222.

Figure 21:
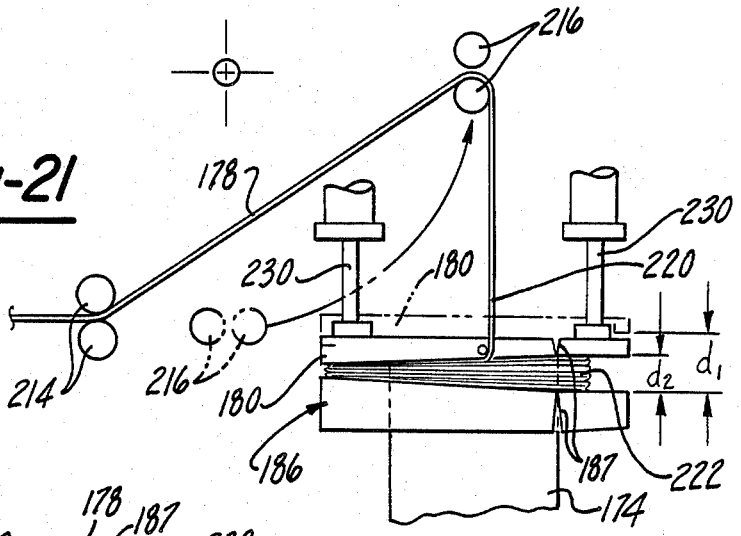
Figure 23:
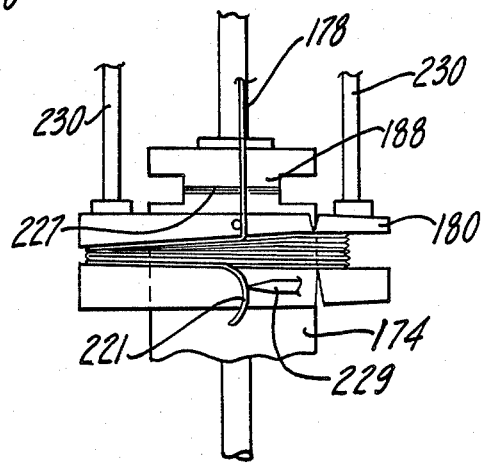
Figure 24:
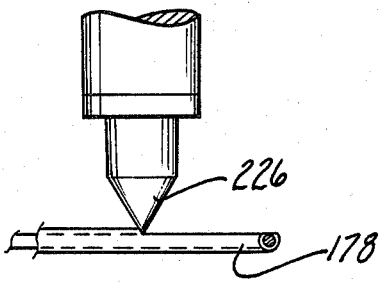
FIG. 24 illustrates the insulation piercing structure of the apparatus of FIG. 17.

FIGS. 21 through 23 illustrate the preferred apparatus and method for the pressing and bonding of the wire turns of each coil segment 222. Once the winding of each coil segment 222 is completed, and the guide rollers 216 have pivoted into their position as shown in FIG. 21, a pair of rams 230 extend to forcibly decrease the spacing between the integral winding form 180 and the split winding form 186 from a distance $d_1$, to a distance $d_2$, as indicated in FIG. 21, thereby forcibly compressing the turns of the coil segment 222. Such compression of the coil segment 222 further minimizes the space or gaps between the individual turns of wire and thereby maximizes the use of the space around the toroidal transformer 10.

The integral winding form 180 and the split winding form 186 are preferably hinged, as indicated by reference numeral 187, so as to overcompress the wider outboard leg of the coil segment 222. Such hinged arrangement on the winding forms 180 and 186 thereby form sides on the coil winding segment 222 that are parallel both to each other and to a radial center-line through said segment. Alternatively, the facing surfaces of the winding forms 180 and 186 may be biplanar with the portions adjacent the outer leg of the coil segment 222 being parallel, thus eliminating the need for the hinges 187 while accomplishing nearly the same result.

While the coil segment 222 is held in its compressed state, as illustrated in FIGS. 21 through 23, the exposed portion of the wire 178 is engaged by the electrode 227 located on the winding mandrel 188, as is shown in FIG. 23. Another electrode 229 makes contact with the previously pierced and exposed portion of the wire 178 in the loop portion 221 on the other side of the coil segment 222. The winding apparatus 170 then briefly applies a high frequency voltage through the coil segment 222 which quickly heats the periphery of the wire 178 to a temperature of approximately 175° C. and causes the thermo-setting adhesive insulation to bond to itself. Because the high frequency voltage causes only the periphery of the wire 178 to heat up substantially, while leaving the center or core relatively cool, the interior of the wire acts as a heat sink after the voltage is removed. Thus the coil segment 222 cools quickly and as a result is wound, compressed and bonded into its final wedge-shaped configuration.

Alternatively, a high current (D.C. or low frequency A.C.) may be imposed across the coil segment 222, causing an essentially uniform temperature elevation of conductor which in turn causes the surface adhesive coating to flow and bond. Although such alternate method results in a somewhat longer cool-down period than the above-described preferred method, this result is mitigated somewhat by the heat sink effect of the winding forms 180 and 186 drawing heat from the coil segment.

The upper and lower carriers 192 and 194 then engage the upper and lower form portions 182 and 184, the locking pins 206 retract, and the armatures 200 extend, as shown in FIG. 22, thereby allowing the form portions 182 and 184 to be moved away from the winding mandrel 188. Finally, the rams 230 extend even further to push the winding form 180 and the coil segment 222 onto the storage mandrel 174. The winding form 180 is retracted and the winding of the coil sgments from the continuous wire 178 continues as described above until the required number of segments have been formed to make up a complete high voltage coil section 61 or 62, at which time the continuous wire 178 is automatically severed. The previously pierced portions of the loop portions 221 are covered with pieces of insulation, if necessary, upon final assembly.

FIGS. 25 and 26 illustrate the fabrication and annealing of the core 20, which may be performed independently of the above-described operations. In FIG. 25, the ribbon-shaped stock core material 260 is fed into a core forming apparatus 262, including tension rollers 263 which tightly wind the core material 260 onto a spindle 266, thereby forming a core coil 264, preferably in the size and shape of the finally wound-in core 20 in FIG. 1. When the build of the core reaches the dimension for the transformer being manufactured, a stack gauge or sensing mechanism 268 causes the winding mechanism to stop and a cutting blade (not shown) to automatically sever the core material 260. The core coil 264 is then secured by a steel banding strap or by spot welding the finished end to the remainder of the coil to maintain its shape and annealed in an annealing oven 270, as shown schematically in FIG. 26, to relieve the internal stresses resulting from the winding operation.

If the thin-gauge amorphous steel is used for core material, the core winding step may not be necessary. In such a case, the amorphous steel may be wound in place directly into the core insulation tube 30 and annealed in place while a magnetic field is simultaneously being applied by the energized windings, thereby obtaining the optimum magnetic performance due to the core being annealed to its operating position. Even though the annealing temperature of amorphous steel is relatively low (approximately 350C), the insulation on the electrical coils would have to be selected so that it would be capable of withstanding such temperatures for a short time.

Referring back to FIGS. 7 and 8, and the related description, the major components are each fabricated as described above and then assembled into two transformer sections 11 and 12 (see FIG. 1), which are joined by means of a core sleeve 280 as is illustrated in FIGS. 27 and 28. The use of a core sleeve 280 will generally be required for magnetic cores fabricated from the typically thin amorphous metals, but may not be required for the thicker conventional silicon steel core material (typically 9 mils to 12 mils in thickness) as described below. The core sleeve 280 is formed from a strip of core material with one or more protrusions or tabs 282 cut or lanced and bent outwardly from one end thereof. The core sleeve 280 may be slightly thicker than that used for winding the core 20 in order to provide added stability during the wind-in process. The core sleeve 280 is inserted into the arcuate elongated passage or tunnel in the core insulation tube 30, as shown in FIG. 27. The ends 284 and 286 are then fixed to each other, with the tabs 282 left in their outwardly-protruding positions, preferably by resistance spot welding as shown in FIG. 28. The end 286 preferably overlaps the end 284, as shown in FIG. 28, so as to form a backward-facing step 292 relative to the direction of rotation of the core sleeve 280 during core wind-in, as indicated by direction arrow 288. The provision of the backward-facing step 292 helps to minimize the friction and hang-up between the core sleeve 280 and the core insulation tube sections 31 and 32.

When finally installed, the core sleeve 280 acts as a bushing or bearing which is freely rotatable about the inner walls of the core insulation tube sections 31 and 32. The use of a core sleeve 280 is preferred, at least for amorphous metal core materials, in order to allow the core material to be seated against the tabs 282, and to minimize the possibility of the core material snagging or becoming hung-up on the core insulation tube 30, during the core wind-in operation described below. Furthermore, the core sleeve 280 helps to keep the transformer sections axially aligned prior to and during the wind-in operation. However, to avoid breaking the welds or otherwise damaging the core sleeve a suitable carrier (not shown) may also be used when transporting the core-less sub-assembly to be sure that the sections 11 and 12 are maintained in their proper relative positions. A pair of transformer section handling clamp-type structures, such as those indicated by reference numeral 290 in FIG. 27, may also be used for ease in handling the sub-assembly both before, during and after installation of the core sleeve 280.

As is mentioned above, a core sleeve 280 may not be necessary for cores fabricated from the thicker conventional silicon steel. In such a case, as shown in FIG. 28A, a tang 281 is formed on the initial end of the core material. The tang 281 is adapted to be received in a slot 283 formed in the core material at a distance from the initial end substantially equal to the circumference of the inner wall of the core insulation tube 30. As the core material 280 is initially wound in, the tang 281 is secured in the slot 283 to form an integral core "sleeve", and the wind-in process continues essentially as described below.

Figure 30:
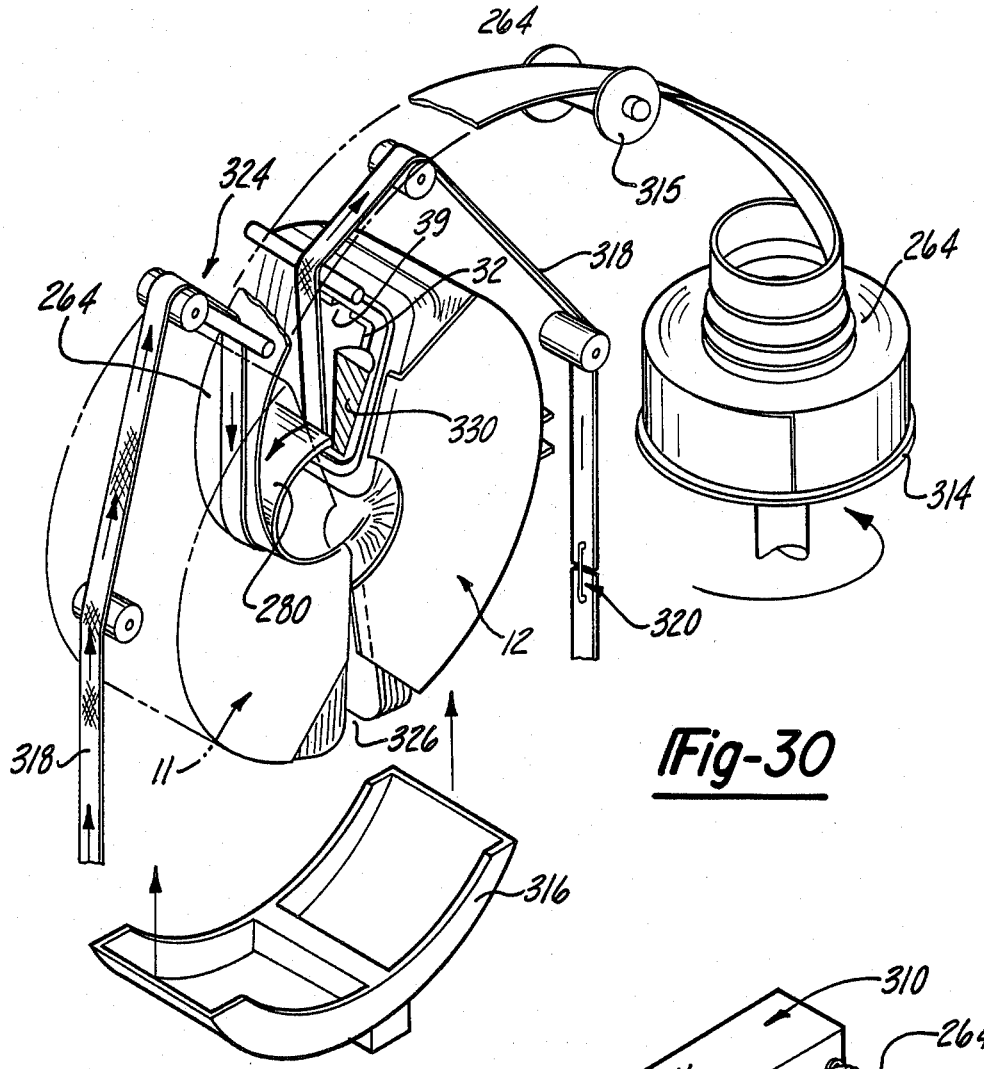
FIG. 30 is a schematic view of the major portions of the apparatus of FIG. 29.
Figure 31:
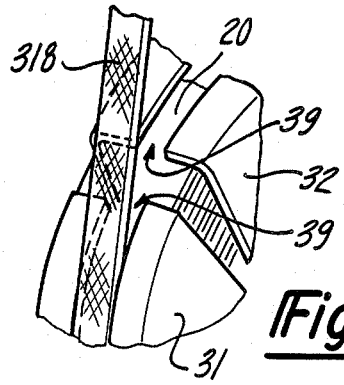
FIG. 31 is a fragmented detail view of the winding belt position at the completion of the core wind-in operation.
Figure 29:
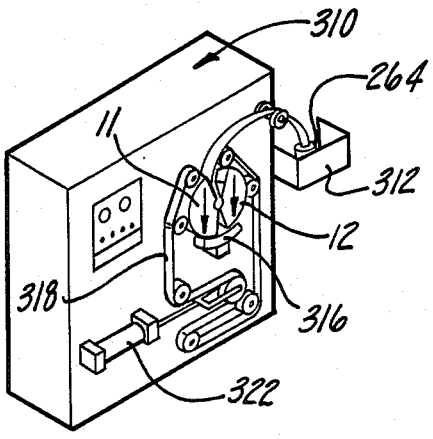
FIG. 29 is a overall perspective view of a preferred core wind-in apparatus of the present invention.

FIGS. 29 through 31 illustrate the preferred apparatus and method for winding the previously annealed core material 264 into the window or tunnel of the core insulation tube 30. A preferred wind-in apparatus 310 generally includes a core material support assembly 312 having a rotating table 314 for rotating the core material 264 during wind-in, a support roller or pulley 315 for suporting the core material 264, a coil support fixture 316 for aligning and supporting the transformer sections 11 and 12, a driven endless drive belt 318 (with a disconnectable joint 320) for supporting and winding in the core material 264, and a belt-tensioning mechanism 322 for automatically maintaining proper tension on the endless drive belt 318 during the wind-in operation. The belt-tensioning mechanism 322 may comprise a pneumatic or hydraulic cylinder, for example, with an idler roller or sheave on the outer end of its piston rod for engaging the endless drive belt 318 as shown in FIG. 29. The pre-assembled coreless transformer sections 11 and 12, with the core sleeve 280 in place, are positioned on the preferred wind-in apparatus 310 with their axis oriented horizontally. Such horizontal axis orientation is preferred so that the endless drive belt 318 may support the weight of the core 20 as it is being wound, thereby aiding in the maintaining of tension on the endless drive belt 318 and in the centering of the core 20 with the transformer sections 11 and 12. In contrast, however, the weight of the transformer sections 11 and 12 is preferably supported by the coil support fixture 316. Various automatic controls known to those skilled in the art are also provided for the various functions described herein.

As was discussed above, the transformer sections 11 and 12 each extend circumferentially through an arc preferably of approximately 165 degrees, thereby forming a circumferential gap of approximately 15 degrees on each side of the completed toroidal transformer 10. Thus, when the transformer sections 11 and 12, with the core sleeve 280 in place, are positioned on the coil support fixture 316, they may be rotated slightly such that the upper gap 324 forms an angle of approximately 25 degrees and the lower gap 326 forms an angle of approximately 5 degrees, thereby allowing sufficient clearance to feed the core material 264 through the upper gap 324 and wind it in place within the core insulation tube 30, thereby forming the annular magnetic core 20.

Once the transformer sections 11 and 12 are properly positioned on the wind-in apparatus 310, the end of the core material 264 is inserted through the upper gap 324 and restrained by the tabs 282 of the core sleeve 280 (see FIGS. 27 and 28). As was described in detail above, the core material 264 is pre-wound and pre-annealed into a configuration substantially identical to that of the finished core 20. Accordingly, the core material 264 is fed into and wound in place within the core insulation tube 30 from the inside, or inner diameter, of the pre-wound, pre-annealed core coil. As a result the finished preferred core 20 is a continuous, tightly wound, substantially stress-free structure, with virtually no air gaps, thereby maximizing the magnetic flux flow of the core 20 and the efficiency of the toroidal electrical transformer 10.

In order to wind-in the core material 264, the endless belt 318 is fed through the upper gap 324 such that it partially surrounds and engages both the core sleeve 280 and the end portion of the core material 264 as is shown in FIG. 30. The endless drive belt 318 may then be reconnected at the joint 320, and the belt-tensioning mechanism 322 may be activated, thereby tensioning the endless drive belt 318 and preparing the apparatus for the wind-in operation. When the wind-in apparatus 310 is started, the rotating table 314 begins to rotate at a speed that is automatically synchronized with the movement of the endless drive belt 318, which drivingly feeds and winds the core material 264 through the upper gap 324 and around the core sleeve 280.

A pair of spring loaded conical rollers 330 (only one of which is shown) are preferably provided on opposite sides of the upper gap 324 and apply a light force on the edges of the core material 264 to keep the layers properly aligned during winding. The conical rollers 330 may be driven, if desired, in order to assist the endless drive belt 318 in winding the core material 264. A conical shape for such rollers is preferred for purposes of matching their surface speed along the line of contact with the core material 264 with the increasing speed of the core material 264 as the core is rotated during winding.

As the core material 264 is wound into the core insulation tube 30, the diameter of the core 20 increases as the core builds, layer-by-layer. Accordingly, the belt-tensioning mechanism 322 automatically adjusts to allow for the increased core diameter and to maintain the proper level of belt tension. The process continues until the core 20 is complete, at which time the endless belt 318 leaves the core insulation tube 30 through the gap 39 between the outer wall portions thereof, as shown in FIG. 31. The provision of the gap 39 thus allows the core insulation tube 30 to be completely filled with the core material 264 without leaving an unusable annular space for the endless drive belt 318 around the periphery of the core 20. Once the endless drive belt 318 is removed upon completion of the core 20, the gap 39 may be filled with an insulative transformer cooling fluid, thus achieving dielectric insulation sufficient to withstand voltage stresses between the core and the low voltge windings.

For final assembly of the preferred toroidal electrical transformers 10, the transformer sections or half-portions 11 and 12 are rotated back to their original positions with equal circumferential gaps of approximately 15 degrees on each side. The corresponding ends of both the low voltage coil sections 41 and 42 and the high voltage sections 61 and 62 are connected together or fitted with external connector devices as required for the desired application of the transformer. The upper and lower portions of the supporting blocks 80, shown in FIG. 1, are inserted into the 15 degree circumference gaps and are secured together by suitable fastening means known to those skilled in the art. The assembly is then ready for mounting in a housing or containment structure, such as that indicated by reference numeral 85 in FIG. 1, and for evacuating and charging with transformer cooling fluid, which is typically an electrical grade insulation oil.

The present invention, as disclosed above, provides for an electrical transformer, which is suitable for either step-down or step-up applications, and which employs continuously wound high and low voltage coils as well as a continuous magnetic core, all of which are arranged in a toroidal or annular configuration. By such a structure and configuration, the toroidal electrical transformer according to the present invention provides for maximum efficiency and optimum use of space, thereby representing a great stride in the advancement of transformer technology. Furthermore, it is believed that the disclosed method and structure for the continuously wound-in core of the present invention allows the greatest use of the efficiency gains to be derived from the use of the thin-gauge amorphous metal core materials rather than the traditional grain-oriented material.

Although the discussion herein, in connection with the FIGS. 1 through 31, discloses the structure and method of production for the toroidal electrical transformer 10, alternate structures and methods of producing the various components of such a transformer may be employed without departing from the spirit and scope of the invention. The following discussion, in conjunction with FIGS. 32 through 41, illustrate a few examples of other alternate embodiments of the present invention.

Figure 32:
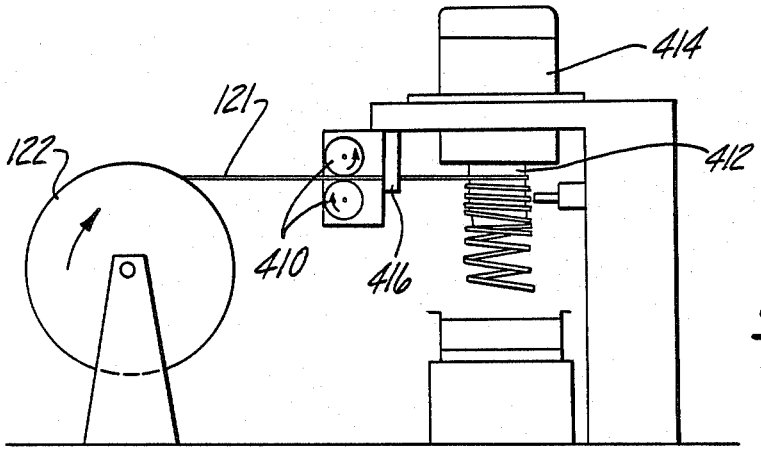
FIG. 32 is a side view of an alternate apparatus for winding the low voltage coil of the present invention.
Figure 33:
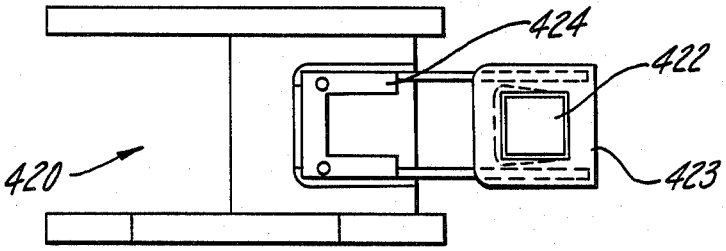
FIG. 33 is a top view of an alternate apparatus for forming the wedge-shaped turns of the low voltage coil.
Figure 34:
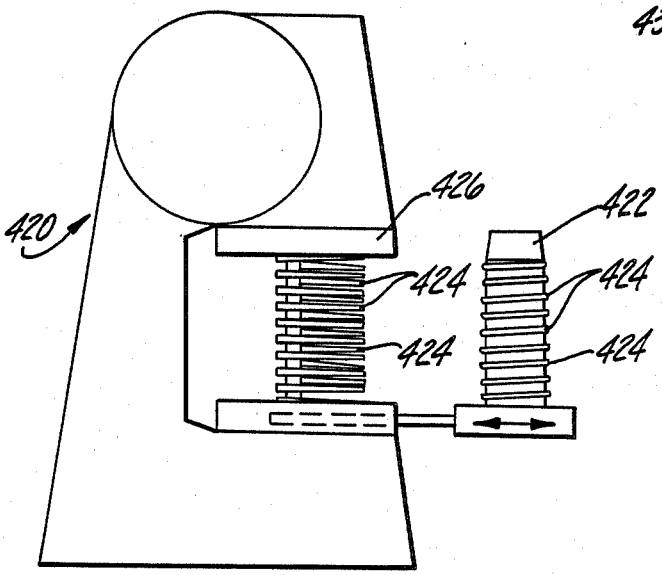
FIG. 34 is a side view of the apparatus of FIG. 33.

FIGS. 32 through 35 illustrate an alternate method and apparatus for forming the low voltage coil sections 41 and 42. In FIG. 32, the conductor feedstock 121 is fed from the reel 122 by means of a pair of tension rollers 410 onto a rotating mandrel 412, driven by a motor 414. After winding the requisite amount of feedstock to form one of the lengths of the coil section 41 or 42, a cut-off mechanism 416 automatially severs the feedstock 121. The length of coiled feedstock is then conveyed to the forming press 420 shown in FIGS. 33 and 34.

At the forming press 420, the coil length is slipped onto a support mandrel 422 and retained by a bearing plate 423. The support mandrel 422 is then moved into a position such that each of the turns 424 of the coil length is between a pair of tapered press forms 424. An upper press plate 426 is then forcibly urged downward, as viewed in FIG. 34, to compress the turns 424 of the coil length into the same wedge-shaped configuration as is discussed above in connection with the preferred low voltage coil forming apparatus.

Figure 35:
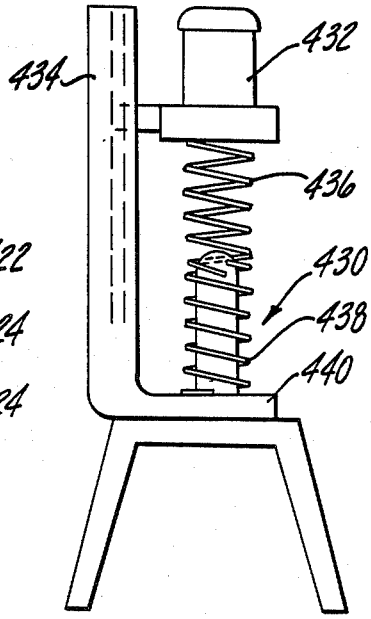
FIG. 35 is a side view of an alternate interleaving apparatus for two lengths of low voltage coil.

Two of the coil lengths are then inserted into a winding apparatus 430 for interleaving as is shown schematically in FIG. 35. The winding apparatus 430 includes a rotatable head 432 which is movable upwardly and downwardly on a support post 434. The upper coil length 436 is attached to the rotatable head 432 and is turned as it is moved downwardly to interleave the upper coil length 436 with the lower coil length 438 which is fixed to a stationary base plate 440.

FIGS. 36 and 37 illustrate still another alternate low voltage coil structure and a method of forming such a coil. The structures and method shown in FIGS. 36 and 37 are especially well-suited for winding the low voltage coil from pre-insulated conductor because of the limited forming required by such method. As is perhaps best seen in FIG. 36, a pair of parallel bifilar conductors 450 and 452 are wound together. Each of the conductors 450 and 452 has a generally rectangular, or possibly square, cross-section and are preferably copper thereby reducing electrical losses and more efficiently using the available space because of the smaller cross-section. It should be noted, however, that it may be desirable for each of the conductors 450 and 452 to be of a different cross-section, one of a square and one of a non-square rectangular cross-section, or each of different rectangular dimensions, for example.

The bifilar conductors 450 and 452 are wound in a manner so as to lie one inboard of the other in a radial direction, relative to the toroidal transformer, on the inner legs of the low voltage coil. As they are wound, however, the conductors 450 and 452 are turned or rotated 90 degrees in the upper radial portion so as to lie side-by-side in the circumferential direction, relative to the toroidal transformer, on the outer legs. On the lower radial portion, the conductors 450 and 452 are then turned or rotated 90 degrees in the opposite direction, thus returning to their original orientation (one inboard of the other) on the inner legs of the coil. It should be noted that the same two faces of the conductors 450 and 452 remain in contact with each other throughout each winding turn. Furthermore, as is shown in FIGS. 36 and 37, the turned portions on the upper and lower radial portions of adjacent turns are circumferentially nested together in order to conserve space.

Such a construction, as shown in FIGS. 36 and 37, thereby approximates the wedge-shaped configuration of each turn of the above-discussed preferred low voltage coil 40, without the necessity of the substantial forming operations which would tend to damage the pre-insulated conductor. Even though the construction of a coil formed as shown in FIGS. 36 and 37 only approximates a wedge-shaped for its turns, and thus does not make the most efficient use of space in the toroidal electrical transformer, such a construction may be desirable in applications where such efficient space utilization is not critical. However, through modest forming in conjunction with the turning described above, efficient use of space may be improved.

Figure 38:
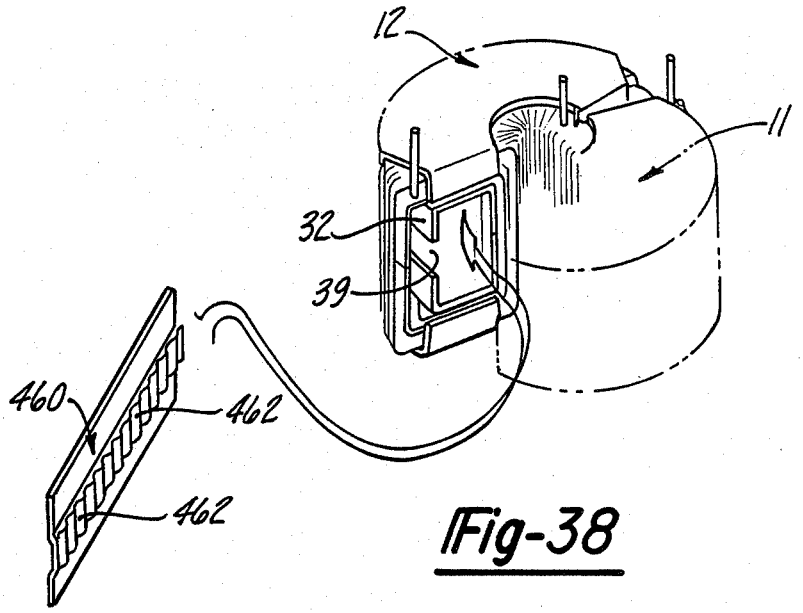
FIG. 38 illustrates an alternate core sleeve of the present invention.
Figure 39:
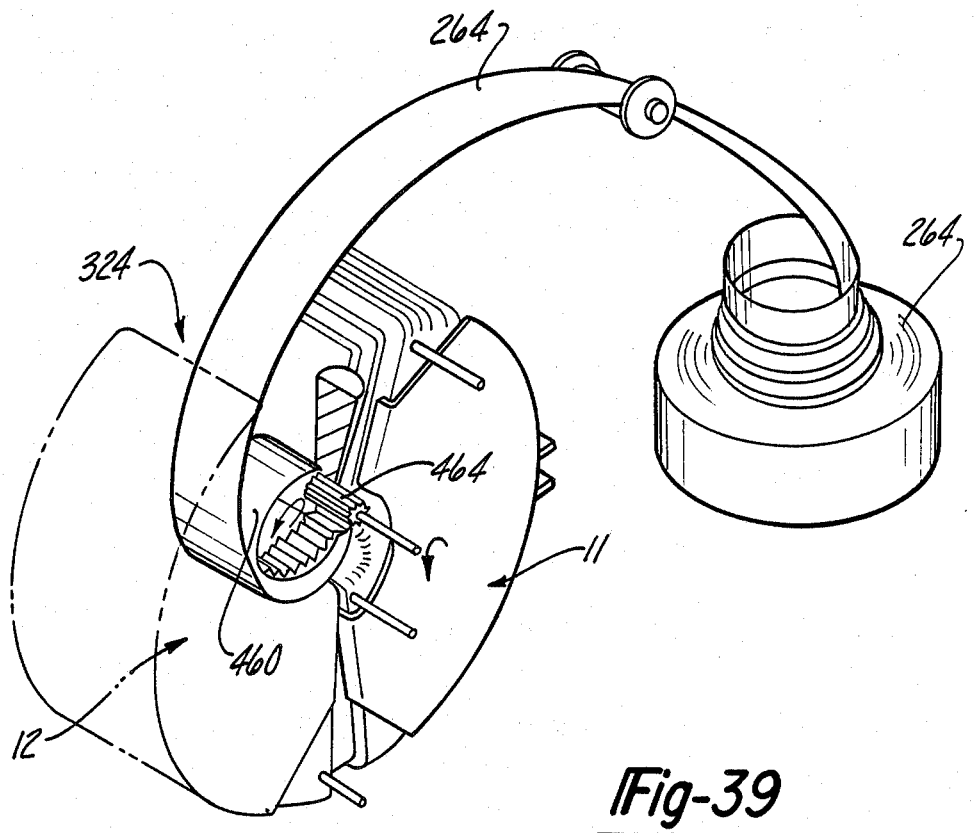
FIG. 39 illustrates an alternate method for winding in the core material, using the alternate core sleeve of FIG. 38.

FIGS. 38 and 39 illustrate an alternative core wind-in method, employing an alternate core sleeve 460 which includes a plurality of gear teeth 462, preferably stamped or forged therein such that the overall thickness of the core sleeve 460 is not substantiallyincreased over that of its parent material. Like the core sleeve 280, discussed above in connection with the preferred embodiment, the thickness of core sleeve 460 is preferably greater than that of the core material 264 in order to provide stability during the core wind-in process. Also like the preferred core sleeve 280, the alternate core sleeve 460 preferably remains in place in the core insulation tube 30 after completion of the core 20.

To facilitate the wind-in of the core 20, an end of the core material 264 is attached to the core sleeve 460. Such attachment may be made in any of a number of ways, such as by spot welding the end of the core material 20 to the outer surface of the core sleeve 460 or by way of lanced tabs thereon similar to the protrusions or tabs 282 shown in FIGS. 27 and 28. A pinion gear 464 is positioned in the circumferential space or gap 324 between the transformer sections 11 and 12 and drivingly rotated so as to rotate the core sleeve 460 and wind-in the core material 264 in lieu of the endless drive belt 318 of the preferred apparatus shown in FIGS. 29 and 31 and discussed above.

Figure 40:
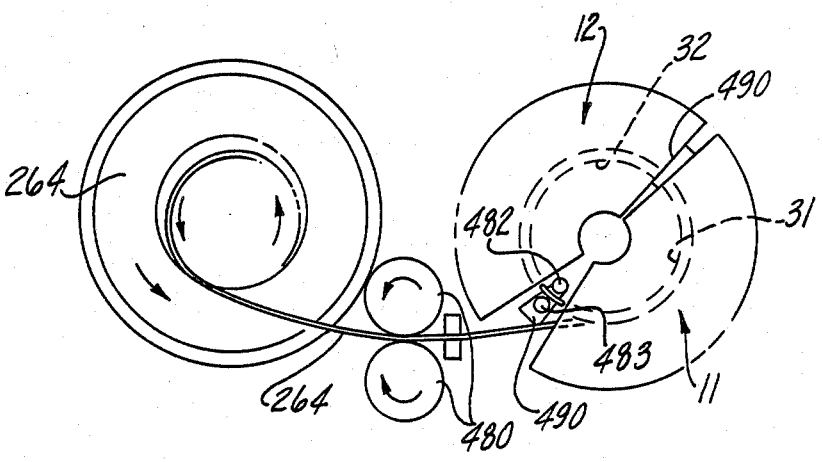
FIG. 40 is a top view of still another alternate core wind-in apparatus according to the present invention.
Figure 41:
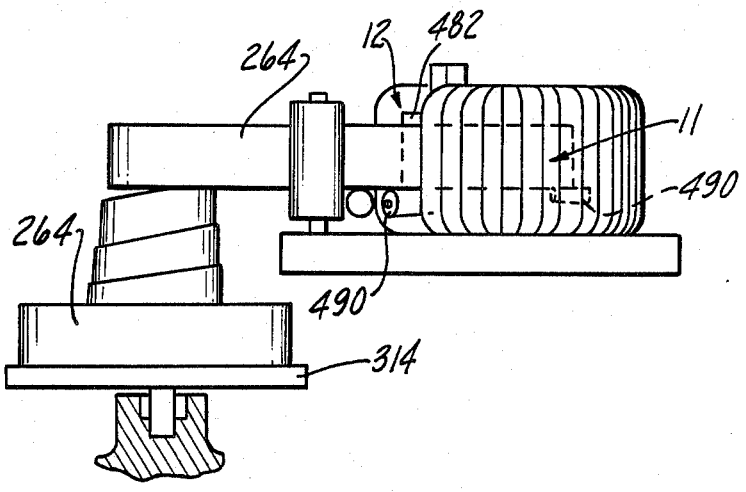
FIG. 41 is a side view of the apparatus of FIG. 40.

Finally, FIGS. 40 and 41 illustrate still another alternate method and apparatus for winding in the core 20, which is perhaps less desirable for use with the thin-gauge amorphous metal core materials than it is for use with the heavier and thicker, grain-oriented metal materials. In such alternate apparatus, the inner end of the previously wound and annealed core material 264 is fed through a pair of tensioning rollers 480 and pulled by a drive roller 482 and a spring-loaded back-up roller 483 until a complete loop is formed around the inner walls of the core insulation tube sections 31 and 32. A tack weld is made to secure such inner loop to the remainder of the incoming core material 264, and the wind-in process continues until the entire core 20 is formed. Alternatively, the inner end of the core material 264 may be secured to a core sleeve 280 as is described above in connection with the preferred wind-in method. The core material 264 is supported and rotated on a rotating table 314, similar to that described above, and a pair of conical support rollers 490 are disposed in the gaps between the tranformer sections 11 and 12 for vertically supporting the core material 264 during the wind-in process.

The foregoing discussion discloses and described merely exemplary methods and embodiments of the present invention. One skilled in the art will readily recognize from such discussion that various changes, modifications and variations may be made therein without departing from the spirit and scope of the invention as defined in the following claims.

What is claimed is:

1. An apparatus for winding an annular magnetic core for an electrical transformer substantially from a continuous strip of magnetic material, said electrical transformer including coil means having arcuate elongated passage means extending therethrough being at least three fourths of a complete annular toroidal passage and leaving a circumferentially-extending gap means communicating with said arcuate elongated passage means, said apparatus including a belt means forming a loop which enters said arcuate elongated passage means through said gap means and egresses said arcuate elongated passage means through said gap means, said apparatus further including drive means for driving said belt means and feed means for feeding said continuous strip of magnetic material through said gap means so as to engage said belt means to wind said magnetic material in place within said arcuate elongated passage means to form said annular magnetic core as said belt means is driven by said drive means, said feed means includes guide means for axially aligning said strip of magnetic material as it is fed through said gap means, said belt means engaging the radially-outward winding of said annular magnetic core as it is being wound within said arcuate elongated passage means, said drive means being adapted to drive said belt means until said annular magnetic core is fully wound within said arcuate elongated passage means, said guide means includes at least one roller engaging the rotating edge of said annular magnetic core as it is being wound within said arcuate elongated passage means and also engaging the edge of said strip of magnetic material as it is fed through said gap means, said roller being frusto-conical in shape and extending in a generally radial direction along the edge of said annular magnetic core with its smaller end oriented toward the center of the magnetic core, whereby the surface speed of said frusto-conical roller substantially equals the rotational speed of the edge of said annular magnetic core.

2. An apparatus according to claim 1, wherein the axis of said annular magnetic core is oriented horizontally, the weight of said annular magnetic core being supported substantially by said belt means, said apparatus further comprising coil support means for substantially supporting said coil means

* * * * *